US009091519B2

(12) United States Patent
Lownds et al.

(10) Patent No.: US 9,091,519 B2
(45) Date of Patent: Jul. 28, 2015

(54) APPARATUS AND METHOD FOR BLASTING

(75) Inventors: Charles Michael Lownds, Aurora, CO (US); Ronald F. Stewart, Ottawa (CA); Howard A. Bampfield, Kelowna (CA)

(73) Assignee: ORICA EXPLOSIVES TECHNOLOGY PTY LTD, Melbourne, Victoria (AU)

( * ) Notice: Subject to any disclaimer, the term of this patent is extended or adjusted under 35 U.S.C. 154(b) by 828 days.

(21) Appl. No.: 12/489,702

(22) Filed: Jun. 23, 2009

(65) Prior Publication Data

US 2009/0314176 A1 Dec. 24, 2009

Related U.S. Application Data

(62) Division of application No. 11/354,928, filed on Feb. 16, 2006.

(60) Provisional application No. 60/653,085, filed on Feb. 16, 2005, provisional application No. 60/715,133, filed on Sep. 9, 2005.

(51) Int. Cl.

| | |
|---|---|
| ***F42D 1/045*** | (2006.01) |
| ***F42D 1/05*** | (2006.01) |
| ***F41A 17/06*** | (2006.01) |

(52) U.S. Cl.

CPC ..... *F42D 1/05* (2013.01); *F41A 17/066* (2013.01); *F42D 1/045* (2013.01)

(58) Field of Classification Search

USPC ..... 102/301, 200, 306, 215; 361/248, 251

See application file for complete search history.

(56) References Cited

U.S. PATENT DOCUMENTS

| | | | |
|---|---|---|---|
| 4,576,093 | A | 3/1986 | Snyder |
| 4,674,047 | A | 6/1987 | Tyler et al. |

(Continued)

FOREIGN PATENT DOCUMENTS

| | | |
|---|---|---|
| AU | 198778265 | 4/1988 |
| CA | 2423936 A1 | 3/2003 |

(Continued)

OTHER PUBLICATIONS

Resource and Asset Management: Bell GoTrax™ http://www.businessonthego1.com/english/ws_dataapplications_resource_gotrax.asp (2006).

(Continued)

*Primary Examiner* — Jonathan C Weber

(74) *Attorney, Agent, or Firm* — Nixon & Vanderhye PC

(57) ABSTRACT

Disclosed herein are significant improvements in security and safety of blasting apparatuses intended for use in mining operations. These include the development of an apparatus and method for blasting that involves activation or deactivation of the blasting apparatus in accordance with pre-determined parameters. For example, these parameters may include one or more of: a location of the blast site, a time for the blasting event, a number of previous blasts, a number of previous blasts within a given time period, and identification of detonator identification codes. The activation or deactivation may involve cross-communication between components of the blasting apparatus and/or associated detonators. Such cross-communication may involve electronic or wireless communication means, including for example the use of cell phone technology, or the internet. In this way, preferred apparatuses and methods disclosed herein permit rapid analysis and verification of a geographical location and time for a blasting event, as well as control and logging of the blasting event, all from a remote location.

8 Claims, 9 Drawing Sheets

(56) References Cited

U.S. PATENT DOCUMENTS

| | | | | |
|---|---|---|---|---|
| 4,725,991 | A | 2/1988 | Crenwelge, Jr. et al. | |
| 4,934,269 | A | 6/1990 | Powell | |
| 4,976,199 | A | 12/1990 | Beukes et al. | |
| 5,214,236 | A | 5/1993 | Murphy et al. | |
| 5,369,579 | A | 11/1994 | Anderson | |
| 5,520,114 | A | 5/1996 | Guimard et al. | |
| 5,539,636 | A | 7/1996 | Marsh et al. | |
| 5,689,420 | A | 11/1997 | Brewster | |
| 5,812,252 | A | 9/1998 | Bowker et al. | |
| 5,894,103 | A * | 4/1999 | Shann | 102/215 |
| 5,937,557 | A | 8/1999 | Bowker et al. | |
| 6,079,333 | A | 6/2000 | Manning | |
| 6,082,264 | A * | 7/2000 | Meyer et al. | 102/217 |
| 6,085,659 | A * | 7/2000 | Beukes et al. | 102/215 |
| 6,098,330 | A | 8/2000 | Schmitt et al. | |
| 6,415,542 | B1 | 7/2002 | Bates et al. | |
| 6,422,147 | B1 | 7/2002 | Shann | |
| 6,636,621 | B2 | 10/2003 | Thebaud | |
| 6,644,202 | B1 | 11/2003 | Duniam et al. | |
| 6,789,483 | B1 * | 9/2004 | Jennings et al. | 102/215 |
| 6,837,163 | B2 * | 1/2005 | Hallin et al. | 102/215 |
| 6,851,369 | B2 | 2/2005 | Hummel et al. | |
| 6,941,870 | B2 | 9/2005 | McClure et al. | |
| 6,945,174 | B2 * | 9/2005 | Aebi et al. | 102/215 |
| 7,174,832 | B1 * | 2/2007 | Shann | 102/293 |
| 7,250,901 | B2 | 7/2007 | Stephens | |
| 7,370,583 | B2 * | 5/2008 | Bokvist et al. | 102/215 |
| 7,594,471 | B2 | 9/2009 | Koekemoer et al. | |
| 2002/0088620 | A1 | 7/2002 | Lerche et al. | |
| 2003/0167153 | A1 | 9/2003 | Alexander | |
| 2004/0080411 | A1 | 4/2004 | Renfro | |
| 2004/0129787 | A1 | 7/2004 | Saito et al. | |
| 2004/0225431 | A1 | 11/2004 | Aebi et al. | |
| 2005/0000382 | A1 * | 1/2005 | Hummel et al. | 102/215 |
| 2005/0011388 | A1 * | 1/2005 | Kouznetsov | 102/200 |
| 2005/0103219 | A1 | 5/2005 | McClure et al. | |
| 2005/0252403 | A1 | 11/2005 | DeVries et al. | |
| 2006/0027121 | A1 | 2/2006 | Koekemoer et al. | |
| 2008/0173201 | A1 * | 7/2008 | Johnston et al. | 102/202.5 |

FOREIGN PATENT DOCUMENTS

| | | | |
|---|---|---|---|
| DE | 10356349 | | 6/2005 |
| EP | 0 897 098 | A2 | 2/1999 |
| FR | 2725782 | | 4/1996 |
| GB | 2 385 343 | A | 8/2003 |
| WO | WO 92/08932 | A1 | 5/1992 |
| WO | WO 95/26013 | A1 | 9/1995 |
| WO | WO 99/24776 | A1 | 5/1999 |
| WO | WO 00/60305 | A1 | 10/2000 |
| WO | WO 00/63636 | A1 | 10/2000 |
| WO | WO 01/20538 | A2 | 3/2001 |
| WO | WO 03/098537 | A1 | 11/2003 |
| WO | 2004/020934 | A1 | 3/2004 |
| WO | WO 2005/008169 | A2 | 1/2005 |
| WO | WO 2005/052498 | A1 | 6/2005 |
| WO | WO 2006/010172 | A1 | 1/2006 |

OTHER PUBLICATIONS

Sony FIU-700 Biometric Unit Designated Entrust-Ready™ http://www.entrust.com/news/files/05_02_00_294.htm (2004).

Navigating the Wireless World—Nathan Pugh et al. http://www.pobonline.com/CDA/ArticleInformation/Article/1,9169,124028,00/html (2005).

Enhanced 911—Wireless Services http://www.fcc.pov/911/enhanced/ (2005).

Sensing and Sensors L2005-11B-vapor_sniffing-jauwaert-01 (2005).

Does my cell phone company keep track of me wherever I go? www.straightdope.com/columns/020215.html (2005).

The Post Online—"Hocking to trace calls" www.thepost.ohiou.edu/N.php?article=N2&date=052504 (2005).

A Framework for Location Privacy in Wireless Networks—Yih-Chun Hu http://research.microsoft.com/~helenw/papers/sigasia05.pdf#search=%22A%20framework%20for%20location%20privacy%20in%20wireless%20networks%22 (2005).

Security Intelligence Technologies—Cellular Intercept (GSM) http://www.spyzone.com/dProductDetail.aspx?productID=889&selection=0 (2005).

Bomb Jammer http://www.bombjammer.com (2005).

Hope you like jamming, too http://www.slate.msn.com/id/2092059 (2005).

Global Gadget—Advanced Electronic Suppliers http://www.globalgadgetuk.com/cell%20phone%20jammers.htm (2005).

Netline—(several web pages) http://www.netline.co.il/Netline/ (2005).

Improvised Explosive Devices (IEDs) and Convoy Protection http://security.lifesafety.ca/2004articles/2004sec0048.htm (2005).

Cell can work as a remote http://www.busrep.co.za/general/print_article.php?fArticleId=2508186&fSectionId=552&fSetId=304 (2005).

Reality Mining: Browsing Reality with Sensor Networks; Sensors Magazine, Sep. 2004 http://sensorsmag.com/articles/0904/14/main.shtml (2005).

GPS Cell Phone Tracking www.accutracking.com/ (2005).

PC World.com—Dialed in: GPS Cell Phones http://www.pcworld.com/reviews/article/0,aid,115273,00.asp (2005).

ZDNet.News—Cell phone flaw opens security hole http://www.snapshield.com/Articles_helpful/Cell_phone_flaw.htm (2005).

Localization technologies http://www.cs.huji.ac.il/course/2004/postPC/docs/Localization)2003.pdf (2005).

Spotlight / Pervasive Computing: Challenges in Location-Aware Computer http://john.cs.olemiss.edu/~gfan/ENGR691/Readings/Patt03-IEEE-Pervasive.pdf#search=%22Spotlight%2BPervasive%2BComputing%2Bchallenges%2Blocation%22 (2005).

Tracker Tagging System—System overview http://www.minesite.com.au/category/category.asp?categoryid=4&childid=9 (2005).

Blackhawk Geometrics & GEOVision Case Histories Blast Monitoring—Blast Monitoring http://www.cse.psu.edu/~swankosk/01203757.pdf (2005).

Mining Weekly—"Three new blasting technologies to increase safety and efficiency", http://www.miningweekly.co.za/min/features/explosive/?show=26859 (2005).

Mining Weekly—"Digital blast-control network installed in 12 SA mines in the last 12 months" http://www.miningweekly.co.za/min/features/future/?show=34007 (2005).

Mining Weekly—"New tech links pyrotechnic blasting and electronic blast control" http://www.miningweekly.co.za/min/features/explosive/?show=32495 (2005).

DetNet's HotShot—Next Generation Electronic Detonation http://www.inhandelectronics.com/detnet.asp (2005).

Evaluation of electronic detonators—requirements for shunting & circuit testing http://www.msha.gov/TECHSUPP/ACC/techreports/ShuntingCircuitTesting.pdf (2005).

The Network Control Revolution in Underground Rock Breaking—A J Bizos http://www.explosives.co.za/pdf/blastingnews/nov04blastnews.pdf (2005).

Daveytronic—Digital Blasting System http://www.daveytronic.com/friendly.htm (2005).

Plugging in to Digital Detonation http://rockproducts.com/mag/rock_plugging_digital_detonation/ (2005).

Austdac—Long-Distance Data transmission, Communication, Monitoring and Control System (several websites) http://www.mining-technology.com/company_printable.asp-?ProductSubGroupID=1010&CompanyID=27756 http://www.mining-technology.com/company_printable.asp?ProductSubGroupID=1002&CompanyID=27470 http://www.mining-technology.com/company_printable.asp?ProductSub.GroupID=1002&CompanyID=27755 http://www.mining-technology.com/company_printable.asp?ProductSub.GroupID=1002&CompanyID=5883 http://www.mining-technology.com/company_printable.

(56) References Cited

OTHER PUBLICATIONS asp?ProductSubGroupID=1002&CompanyID=26973 http://www.mining-technology.com/contractors/communications/minecom/ (2005).
Detnet—Electronic Detonator Systems / Blast Control Networks and DetNet Solutions http://www.detnet.com/technology_products/existing.html and http://www.explosives.co.za/content/news/blastingnews/october2002/detnet.asp (2005).
AEL News—Blasting technology refined http://www.explosives.co.za/content/news/whatsnew/technologyrefined.asp (2005).
Explosive growth delivered by Linux http://www.linus.co.za/linux/view/linux/en/page12994?oid=12282&sn=Detail (2005).
Boomerang Tracking www.boomerangtracking.com/en/faq/faq.asp (2005).
Routing and topology repair for Ad Hoc Mobile Networks using highly directional Wireless media—Vanderveen K et al. http://www.geocities.com/vandervn/TopologyRepair.pdf (2005).
Orica Explosives new technology trials deliver results http://www.orica.com.au/BUSINESS/COR/orica/COR00254.NSF/Page/News_Orica_Explosives'_New_Technology_Trials_Deliver_Results (2005).
Orica News http://www.oricaminingservices.com/files/mediaroom/94/1/Orica%20News%20-%20final%20proof.pdf (2005).
Wireless Ad Hoc Networks—Bibliography lists http://w3.antd.nist.gov/wctg/manet/manet_bibliog.html (2005).
Wireless Communications for Smart Dust—Pister, K. et al. http://robotics.eecs.berkeley.edu/~pister/publications/1998/smartdust_comm_memo.pdf#search=%22Wireless%20communications%20for%20Smart%20Dust%22 (2005).
What is Smart Dust Anyway? http://www.wired.com/wired/archive/11.06/start_pr.html (2005).
Exploring the Limits of System Integration with Smart Dust—Warneke, B.A. and Pister, K. et al. http://www-bsac.eecs.berkeley.edu/archive/users/warneke-brett/pubs/imece2002-34360.pdf#search=%22Exploring%20the%20Limits%20of%20System%20Integration%20with%20Smart%20dust%22 (2005).
Dust Networks http://www.dust-inc.com/products/main.shtml (2005).
Crossbow Technology Inc. http://www.xbow.com/Products/productsdetails.aspx?sid=3 (2005).
Smart Dust http://www-bsac.eecs.berkeley.edu/archive/users/warneke-brett/SmartDust/index.html (2005).
Smart Dust—Autonomous Sensing and Communication in a Cubic Millimeter http://robotics.eecs.berkeley.edu/~pister/SmartDust/ (2005).
Challenges in Location-Aware Computing http://www.cs.cmu.edu/~jasonh/courses/ubicomp-f2004/papers/05-loc.aware.computing.pdf#search=%22Challenges%20in%20Location-Aware%20Computing%22 (2005).
Nanotechnology Now—SmartDust & Ubiquitious Computing http://www.nanotec-now.com/smartdust.htm (2005).
Smart Dust Advances in Russia http://www.gateway2russia.com/st/art_260273.php (2005).
Smart Dust and RFID Technology: Solutions for Business and Industry—John Suh http://wca.org/SIGS/RFID/RFID_SensorNeetworks.pdf (2005).
Nanotechnology—(two articles: "Ultra-sensitive explosive detectors" and "Smart Dust—a new porous-silicon-based nanotechnology") http://invent.ucsd.edu/news/newsletters_brochures/Nanotech2004.pdf (2005).
Smart Dust to Aid Military, Civilian Users http://www.dailycal.org/article.php?id=10951 (2005).
Visualizing the Upstream Future—Wood, Tony http://www-1.ibm.com/industries/cpe/download0/22030/chemical_visualizing.pdf or http://www.can.ibm.com/imc/petroweb/pdf/p13882visualizing.pdf (2.2—Intellligent Devices—Smart Dust) (2005).
National Defense Center for Environmental Excellence http://aec.army.mil/usaec/technology/uxo-407.pdf (2005).
Fractal Hash Sequence Representation and Transversal—Jakobsson, Markus http://www.informatics.indiana.edu/markus/papers/isit02.pdf (2005).
"Ionospheric signature of surface mine blasts from Global Positioning System measurements"—Calais, E; Minster, J B; Hofton, M A; Hedlin, M A H, Geophysical Journal International, 1998, v.132, No. 1, p. 191, 12 p.
Scientists exploit the Global Positioning System—Palmer, Paul http://physicsweb.org/articles/world/10/9/5/1 (2005).
Extended European Search Report, European Application No. 07017284.6, completed May 26, 2010.

* cited by examiner

Error!

APPARATUS AND METHOD FOR BLASTING

CROSS-REFERENCE TO RELATED APPLICATIONS

This application is a divisional of co-pending U.S. patent application Ser. No. 11/354,928 filed Feb. 16, 2006, which claims the priority right of U.S. Patent Application Ser. No. 60/653,085 filed Feb. 16, 2005 and U.S. Patent Application 60/715,133 filed Sep. 9, 2005 by Applicants herein.

FIELD OF THE INVENTION

The present invention relates to the field of blasting, for example for the purposes of blasting rock for mining. In particular, the present invention relates to apparatuses and methods that include safety features to reduce the risk of inadvertent or illicit use of one or more components of the blasting system.

BACKGROUND TO THE INVENTION

Mining operations often employ the use of a blasting system or apparatus for controlling actuation of an array of explosive charges. Typically, explosive charges are positioned at the blast site, for example in drilled boreholes, and detonators are associated with the explosive charges. During a blast event, signals may be transmitted to the detonators (often via shock tube, low energy detonating cord, electrical wires or wireless means) to cause initiation thereof, which in turn triggers actuation of each associated explosive charge. The efficiency and success of the blasting event may depend largely upon the careful positioning and timing of actuation of the explosive charges relative to one another.

During blasting operations, safety and security are paramount to blasting apparatuses, and those operating them. Over recent years, much research and development has provided improvements in safety, with the aim to minimize the risk of injury or death at the blast site. However, there remains significant room for improvements in both the safety and security of blasting apparatuses. In particular, the majority of the blasting apparatuses of the prior art include safety features designed to minimize the risk of inadvertent system setup, or improper or inadvertent detonator actuation, by an experienced blast operator. In contrast, perhaps less research and development can be attributed to the provision of blasting apparatuses that have restricted function in the hands of unauthorized users. For example, such unauthorized users may include children or terrorists. Examples of such systems are discussed briefly below.

In one example, International Patent Application PCT/AU00/00351 published Oct. 26, 2000 discloses a method and system for controlling a blasting network for use where spurious command signals may be passed through a blasting controller to the blasting network without the authorization of the authorized user, for example when the controller is connected to the Internet or an Intranet. The system includes a firewall whereby the communication link between the controller and the blasting network can be placed in a control mode by a switch. In the control mode, designated unsafe messages are prevented from reaching the blasting network.

In yet another example, U.S. Pat. No. 6,644,202 issued Nov. 11, 2003, discloses a method and apparatus for use in establishing a blasting arrangement by loading at least one detonator into each of a plurality of blast holes, placing explosive material in each blast hole, connecting to a trunk line a control unit that has a power source incapable of firing the detonators, sequentially connecting the detonators, by means of respective branch lines, to the trunk line and leaving each detonator connected to the trunk line. In addition the apparatus includes means for receiving and storing in memory means identity data from each detonator, as well as means such as a control unit for assigning a predetermined time delay to each detonator to be stored in the memory means. In this way, the detonators may be programmed to function only with the control unit and the control unit will function only with specific detonators, such that theft or other unauthorized acquisition of components of the blasting apparatus may be foiled.

The prior art discussed above illustrates various improvements in the development of blasting apparatuses, with the intention that they function only in the hands of authorized users. However, the consequences of blasting apparatuses, or components thereof, falling into the wrong hands can be severe, particularly if built-in countermeasures intended to prevent unauthorized usage can be foiled. For this reason, safety concerns remain paramount in the explosives industry, and there remains significant room for corresponding improvements in the safety and security of blasting apparatuses.

BRIEF SUMMARY OF THE INVENTION

It is an object of the present invention, at least in preferred embodiments, to provide a blasting apparatus that is substantially inoperable by unauthorized persons.

It is another object of the present invention, at least in preferred embodiments, to provide a method of actuating a series of explosive charges by way of a blasting apparatus that is operable only by authorized persons.

It is another object of the present invention, at least in preferred embodiments, to provide a blasting apparatus that maintains or adopts an active state suitable for causing actuation of at least one associated detonator only when predetermined parameters such as for example, the location of the blast site, the time of the blast event, or the number of previous blast events, are met.

It is another object of the present invention, at least in preferred embodiments, to provide a method of actuating a series of explosive charges by way of a blasting apparatus that is operable only when predetermined parameters such as for example, the location of the blast site, the time of the blast event, or the number of previous blast events, are met.

The present invention provides significant improvements in security of blasting apparatuses intended for use in mining operations. The inventors have succeeded in the development of an apparatus and method for blasting that involves determination of one or more parameters for a blasting event such as but not limited to: the location of the blast site, the time of the blasting event, and the number of previous blasts for example either at the blast site or within a specific time window. In preferred aspects, the methods or apparatuses of the invention may involve cross-communication between components of the blasting apparatus and/or associated detonators. Such cross-communication may involve electronic or wireless communication, including for example the use of cell phones, satellite communication and/or the internet. In this way, the apparatuses and methods of the invention permit, at least in preferred aspects thereof, rapid analysis and verification of a geographical location and time for a blasting event, as well as control and logging of the blasting event, all from a remote location.

In accordance with one aspect of the invention there is provided an apparatus for controlling actuation of at least one detonator for a blasting event at a blast site, the apparatus comprising:

at least one blasting machine for transmitting command signals to said at least one detonator via direct electrical connection or wireless communication;

at least one parameter assessment component for determining a parameter for said apparatus or a component thereof;

at least one parameter approval component, for comparing said parameter with at least one approved parameter, said at least one detonator being actuatable upon receipt from said at least one blasting machine of at least one command signal to FIRE, only if said parameter and any of said at least one approved parameter correspond.

In accordance with another aspect of the invention there is provided a method of controlling a blasting event at a blast site with a blasting apparatus, the blast site having positioned therein at least one detonator and associated explosive charges, each detonator being adapted to receive via direct electrical connection or wireless communication command signals transmitted or relayed by at least one associated blasting machine, the method comprising:

determining a parameter for said blasting apparatus or a component thereof;

determining whether the parameter matches at least one approved parameter, and if said parameter corresponds to at least one approved parameter then causing said at least one detonator or at least one component of the blasting apparatus to adopt or maintain an active state suitable for actuation of said at least one detonator.

DEFINITIONS

Figure 1:
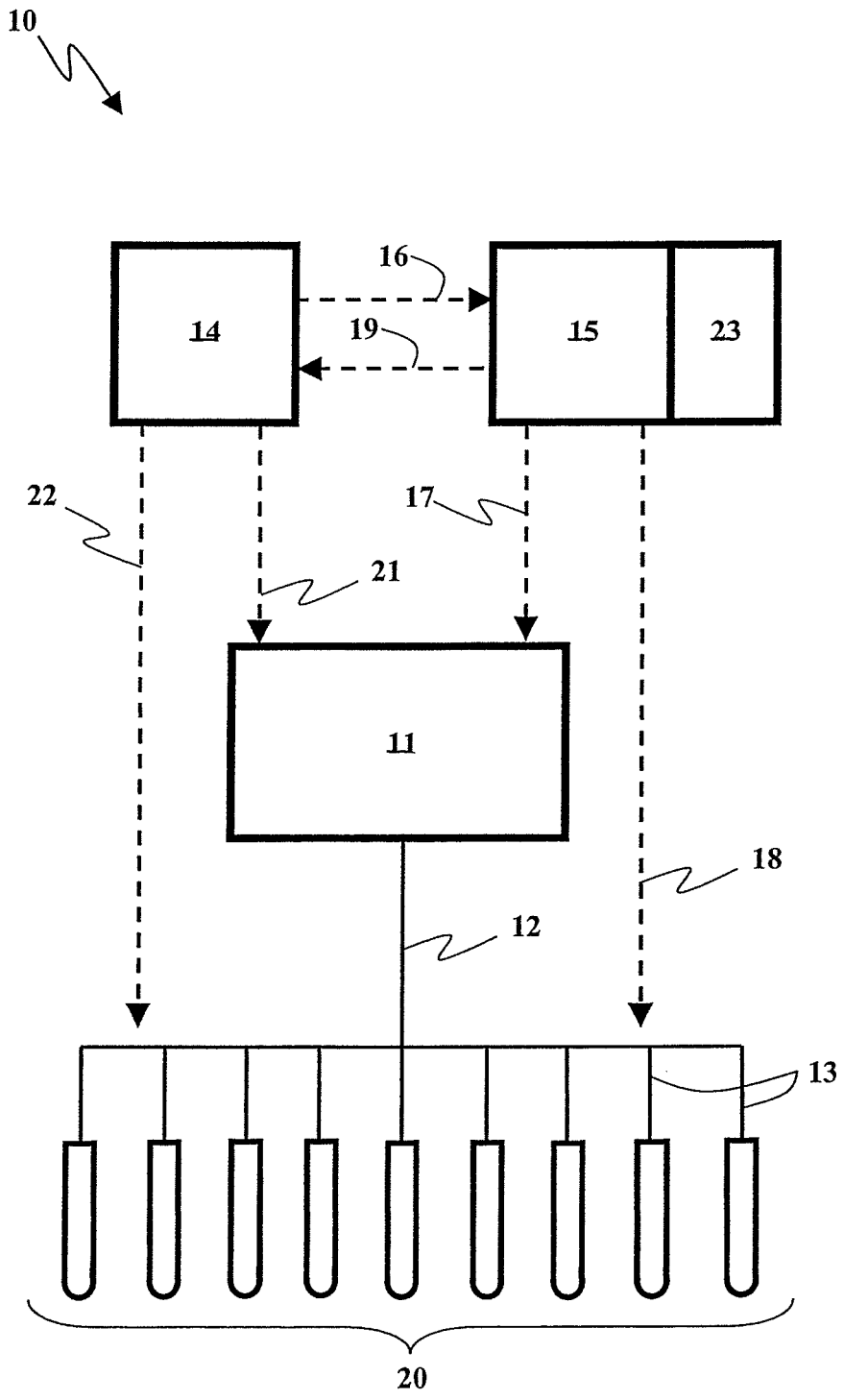
FIG. 1 illustrates a preferred blasting apparatus of the invention.

Active State: refers to a status of a blasting apparatus of the present invention, wherein if a blasting apparatus adopts or maintains an active state, then the blasting apparatus is in a condition suitable for actuation of at least one associated detonator. Other actions may be required by the blasting apparatus in order to achieve actuation of associated detonators, such as for example the transmission to the at least one associated detonator of a command signal to FIRE, and/or a firing code and/or a delay time. However, the general status of the apparatus will not cause a bar to normal operation of the apparatus to cause detonator actuation when the apparatus is in an active state. Any component or means may be utilized to achieve the active state. Moreover, the active state may be caused by passive means (for example an apparatus that remains active in the absence of signals to become inactive) or by a positive mechanism such as the activation or powering-up of one or more components of the apparatus.

Antenna: refers generally to an antenna of a cell phone network for receipt and/or transmission of wireless signals to and/or from wireless devices such as cell phones, or any other form of device capable of sending and/or receiving a wireless signal adapted for communication via the antenna. In preferred embodiments of the blasting apparatus of the invention, use of such an antenna may permit the apparatus to determine for example a location of the blast site and/or permit communication between components of the apparatus to determine if the location is an authorized location.

Approved Location: refers to any location that has been previously approved by an appropriate or designated authority for a blasting event.

Approved Number of Previous Blasts: refers to a number of blasting events that have been previously approved by an appropriate authority according to selected parameters. For example, an approved number of previous blasts may refer to an approved number of blasts within one or more specific time windows, or at a specific blast site within one or more specific time windows. Alternatively, an approved number of blasts may refer to an approved number of blasts conducted by a specific blasting apparatus, or one or more components of a blasting apparatus or for a blast site. In general, the blasting apparatus of the present invention in selected embodiments will not maintain or adopt an active state suitable for actuation of at least one associated detonator unless the number of previous blasts is less than the approved number of previous blasts. In other words, if the number of previous blasts is equal to or exceeds the approved number of previous blasts then the blasting apparatus will not adopt or maintain an active state and may adopt or maintain an inactive state unsuitable for actuation of the at least one associated detonator.

Blasting Machine: a device in signal communication with one or more detonators, for arming, disarming, and firing of the detonators via the receipt and/or relay of signals transmitted from a central command station. A typical blasting machine may be in communication with one or more detonators or groups of detonators via radio-communication or other wireless communication, or direct physical connection (e.g. low energy detonating cord, shock tube, or electrical connection). The term blasting machine also encompasses a device that itself generates command signals, or detonator firing codes, typically in blasting apparatuses that do not employ a central command station. A blasting machine may also be capable of receiving and processing information from detonators associated therewith, including firing codes, delay times, and information regarding the position and condition of detonators. Blasting machines may themselves be assigned a unique identification to differentiate each blasting machine from every other blasting machines in the blasting apparatus or system. Typically, an identification code may be semi-permanently assigned to a blasting machine for a predetermined time period, or for the lifetime of the blasting machine. In more preferred embodiments, a blasting machine is an i-kon blasting machine, most preferably an i-kon Blaster 400 or and i-kon Blaster 1600S.

Blast Number Approval Component: refers to any device or software capable of receiving information relating to a number of previous blasts from a blast number assessment component, and comparing the number of previous blasts with an approved number of previous blasts. In preferred embodiments, a blast number approval component may, upon determining that a number of previous blasts is less than an approved number of blasts cause the blasting apparatus to adopt of maintain an active state suitable for causing actuation of at least one associated detonator. This may, in selected embodiments, involve the transmission of a decision signal to one or more other components of the blasting apparatus.

Blast Number Assessment Component: refers to any device or software capable of recording or storing a number of previous blasting events that have occurred, for example, within a specific time-window, or at a specific blast site. In its simplest form, a blast number assessment component may simply comprise means for counting a previous number of blasting events.

Blast Operator: For the purposes of this specification, a blast operator encompasses anyone who uses or attempts to use a blasting apparatus of the present invention. The expression 'authorized blast operator' refers to a candidate blast operator who has been determined by an appropriate or designated authority, or by components of the blasting apparatus, to be authorized to operate the blasting apparatus by reason of competency and/or sufficient training and/or trustworthiness. In contrast, the expression 'unauthorized blast operator' refers to those blast operators who fail to meet the requirements of an authorized blast operator.

Biometric Analyzer: Any device capable of scanning or otherwise analyzing one or more biometric feature of an individual (e.g. a blast operator). For example, in the case where the biometric analyzer scans a physical biometric feature the device may include a camera such as a digital camera or RF scanning means, and optionally means to store an image such as a digital image. Furthermore, a biometric analyzer may include storage means to store the image and means to communicate the image to a blast authorizing means. Examples of such a biometric analyzer unit include the Sony™ FIU-700 Biometric Unit, those produced under the trade name "V-pass" by the company Bioscrypt, as well as those described in U.S. Pat. No. 5,937,557, issued Aug. 17, 1999. However, biometric analyzers are not limited to those that capture and process images comprising biometric features. In this regard, the expression "biometric analyzer" includes devices that capture other biometric features including but not limited to voices (such analyzers may include a microphone and optionally sound recording means), DNA fingerprints (such analyzers may include DNA sampling, extraction and analysis means), written signatures (such analyzers may include computer-based signatures analysis). Other biometric analyzers may involve the use of skin spectroscopy for example to measure surface or subcutaneous spectral properties of the skin. Other biometric analyzers may detect vein patterns and include means for example to analyze finger vein patterns by the presence of haemoglobin in subcutaneous veins. Such finger vein pattern analyzers may be obtained from manufacturers such as Hitachi.

Biometric Feature: any feature that is unique or substantially unique between two or more persons. Preferably, a biometric feature is readily accessible and suitable for analysis or scanning via a biometric analyzer. Biometric features may be selected from the following non-limiting group: a fingerprint, an iris, a retina, a face, a hand, a DNA fingerprint etc. In other embodiments the biometric feature may include an entire face. Other biometric features include skin spectroscopy (including surface or deep skin spectroscopy), vein patterns such as finger vein patterns (for example assessed by measuring haemoglobin presence in subcutaneous veins). The expression 'biometric feature' is not limited to material features, and may include for example, a voice or spoken word that can be recorded by a biometric analyzer for subsequent analysis, or a signature recognition for a written signature.

Biometric Signature: a biometric signature is an electronically generated code or data packet representative of an individual (e.g. a blast operator) and unique or substantially unique to that individual. Typically, a biometric signature is generated by receiving and processing information regarding one or more of an individual's biometric features, for example by one or more biometric analyzers. Further, a biometric signature may further include additional data such as for example a password, code, geographical coordinates or the handwritten signature of the individual. Optionally, the biometric signature may be encrypted, for example by 32 bit encryption means, thereby to foil attempted retrieval and use of biometric signatures by unauthorized persons.

Blasting Apparatus: For the purposes of this specification, a blasting apparatus may include one or more blasting machines with or without inclusion of associated detonators. The blasting apparatus may further include additional components such as a central command station. The detonators and other components of a blasting apparatus may communicate via physical means such as electrical wires, low energy detonating cord, or shock tube, or alternatively may communicate via wireless means such as radio waves, cell phone-like communication, electromagnetic induction or light (e.g. laser light) signalling means. The expressions 'blasting system' and 'blasting apparatus' are essentially synonymous on the understanding that they may include various physically joined or separate components working in conjunction with one another to control and optionally actuate detonators. A blasting apparatus may comprise components that are located in a similar vicinity, or may include components located remote from one another, including for example components in different countries operating together.

Blast Site: refers to any location at which components of an apparatus of the invention are set up with the intention of conducting a blasting event. A blast site may be an authorized blast site that has been pre-approved by an appropriate authority for a blasting event. Alternatively, a blast site may be an unauthorized blast site, where for example children or terrorists are attempting unauthorized, unintentional or illicit use of the blasting apparatus to conduct a blast. A blast site may encompass a large area, for example encompassing a large mine or several mines. Alternatively, a mine may include several discrete blast sites within its boundaries.

Cell Phone: unless states otherwise, the expression "cell phone" refers either to a cell phone as typically known in the art, or alternatively may also refer to any other form of device capable of sending signals for receipt by a cell phone network and/or receiving signals from a cell phone network, for communication between components of the blasting apparatus of the invention, or between components of the blasting apparatus of the invention and detonators, detonator assemblies, or other external devices. In this way, the cell phone may be located at or near to the blast site, or alternatively may be located remote from the blast site, or even in a different country or continent from the blast site.

Cell Phone Network Connection Means: refers to any device capable of making a connection to a cell phone network operating in the vicinity of the device. Preferably, a cell phone network connection means includes means to determine a location of the device by identifying one or more antenna or receivers used by the device to connect to the cell phone network.

Central Command Station—any device that transmits signals via wireless transmission or by direct connection, to one or more blasting machines. The transmitted signals may be encoded, or encrypted. Typically, the central command station permits radio communication with multiple blasting machines from a location remote from the blast site. Command signals received by a blasting machine from a central command station may be relayed to detonators, or processed by the blasting machine and/or relayed (with possible modification) to detonators as required.

Command Signal: refers to any signal generated for example by a central command station or a blasting machine, for control of a blasting machine and/or detonators associated with a blasting machine at a blast site. For example, such command signals may include, but are not limited to, signals to ARM, DISARM, or FIRE the detonators, or may further include biometric signature information of the blast operator, firing codes for the detonators, other security codes, delay times or any other information related to the blasting event. If generated by a central command station, command signals may be relayed to detonators via an associated blasting machine, or once received via a detonator or detonator assembly, may be relayed between detonator assemblies at the blast site. Command signals may be communicated via wireless communication means, or via electrical connection between components of the blasting system.

Communication Means: Any means transmitting information, such as via electrical wires or wireless means, data from one source to at least one receiver. Transmission may be through wireless communication (e.g. a cell phone network, radio waves, electromagnetic induction, light signalling, satellite signals, a satellite phone etc.), or wired communication (e.g. electrical wires, low energy detonating cord, shock tube etc.).

Computer: refers to any device capable of receiving information relating to one or more parameters of a blast site or one or more components of a blast apparatus at a blast site, or detonators associated therewith, and comparing the information relating to the parameters with previously approved information relating to such parameters. Such parameters may include, but are not limited to, geographical position of the blast site, a time for a blasting event, a number of previous blasts either for the blast site or specific components at the blast site, or a number of previous blasts within a predetermined time window. A computer may be capable of wireless or wired communication with other components of the blasting apparatus of the invention. For example, the computer may in part be connected to other components of the blast apparatus via the internet, or a wireless telephone network. In this way, the computer may be located at or near to the blast site, or alternatively may be located remote from the blast site, or even in a different country or continent from the blast site.

Corresponds: in specific embodiments, a parameter for a blasting event (such as a location, a time, a number of previous blasts, a biometric signature etc.) is described to correspond to a known, predetermined, or preauthorized parameter for the blasting event. For the sake of clarity, the terms "corresponding" or "corresponds" provide that a parameter exhibits identical or at times similar features to a known biometric signature sufficient to deduce that the parameter meets the requirements for a blasting event to proceed. In this way, a determination can be made as to whether the parameter falls within those parameters having the required characteristics for blasting event approval. It should be noted that to achieve correspondence, two parameters need not be completely identical, but at least achieve a degree of similarity greater than a predetermined threshold.

Decision Signal: refers to any signal generated by a parameter approval component such as a location approval component (regarding whether or not a geographical location determined for a blasting event corresponds with an approved blasting location, previously approved by an appropriate authority), a time approval component (regarding whether or not a time for a blasting event corresponds with an approved time, previously approved by an appropriate authority), or a blast number approval component (regarding whether a number of previous blasts is less than an approved number of previous blasts). A decision signal may be positive, resulting in activation (or maintenance in an active state) of the blasting apparatus or components thereof, for actuation of associated detonators. Alternatively, a decision signal may be negative resulting in deactivation (or maintenance of a non-active state) of the blasting apparatus or components thereof, thereby blocking actuation of associated detonators. A decision signal may comprise an electronic or wireless signal transmitted between components of the blasting apparatus, and/or the associated detonators. Alternatively, a decision signal may be retained entirely within an approval component (or an associated component) without transmission to other components of the blasting apparatus or the detonators. For example, where a blasting apparatus already exists in an inactive state, and the decision signal is negative such that an inactive state should be maintained, there may be no need to transmit the decision signal to other components of the blasting apparatus and/or the detonators. Likewise, where a blasting apparatus already exists in an active state ready for actuation of the detonators, and the decision signal is positive such that the blast site is an authorized blast site, and an active state of the blasting apparatus should be maintained, there may be no need to transmit the decision signal to other components of the blasting apparatus and/or the detonators.

Detonator: refers to any form of electronic or electric detonator. Such detonators are well known in the art and typically comprise a shell, a base charge, and means to actuate the base charge in response to some form of electronic signal. In preferred embodiments, 'detonator' relates to those detonators that include programmable initiation means, for example that include means to store unique detonator identification information, and/or detonator firing codes. Furthermore, in preferred embodiments, the detonators and their associated blasting machines may be defined as being "secure", such that "secure" detonators will only be capable of actuation when in association with a corresponding "secure" blasting machine, and likewise a "secure" blasting machine will only be operational when connected to correspondingly "secure" detonators. Dialog between "secure" detonators and corresponding "secure" blasting machines can only occur if the detonators are pre-designated to function with a selected "secure" blasting machine. The term detonator further includes detonator assemblies comprising other components required for the control and actuation of the base charge of the detonator. For example, in the case of a wireless detonator assembly the components may include wireless signal receiving and processing means.

Detonator Firing Code—each detonator firing code may include in electronic form identification information and/or delay time information for each individual detonator or group of detonators.

Detonator Identification Code: refers to any unique or substantially unique code that can be assigned to a detonator that serves to uniquely or substantially uniquely identify the detonator at least to components of a blasting apparatus or components remote from a blast site. For example, each detonator and/or each blasting machine associated with each detonator, and/or a logger may be programmed with detonator identification codes. Preferably, the detonator identification codes allow for identification of a detonator by another component during communication between components of a blasting apparatus for example during control, programming and firing of the detonators. In preferred embodiments a detonator identification code may be assigned to a specific detonator for designating its use at a specific blast site, at a specific location, at a specific time or within a specific time window, or by a specific blast operator.

Detonator Identification Code Assessment Component: includes any software or device capable of assessing, recording or otherwise determining or learning an identification code assigned (previously assigned or to be assigned) to a detonator.

Detonator Identification Code Approval Component: includes any software or device capable of comparing a detonator identification code obtained for example by a detonator identification code assessment component to known detonator identification code assessment components to determine whether each detonator identification code matches or corresponds to a known detonator identification code.

Geographical Position: refers to a location of a device, or an apparatus, or components thereof. A geographical position may constitute co-ordinates such as longitudinal and latitudinal co-ordinates as may be determined, for example, by a GPS device, or alternatively may relate to a position relative to one or more other components of a blast apparatus or a local system for position determination, as may be determined, for example, by an LPS device or an antenna of a cellphone network.

Global Positioning Systems (GPS) Device: refers to any device that receives incoming signals corresponding to a geographical position or area, and processes such signals to arrive at a current geographical location or area for a blast operator or a blast site. Typically, GPS devices rely upon incoming satellite signals in order to determine geographical location, as is well known in the art. Preferred GPS devices are those produced by the company Garmin, and those produced by the company Motorola. For example, most preferred GPS devices include the Motorola MG4200 instant GPS chip.

Inactive State: refers to a status of a blasting apparatus of the present invention, wherein if a blasting apparatus adopt or maintains an inactive state, then the blasting apparatus is in a condition unsuitable for actuation of at least one associated detonator. Even if other normal operations of the blasting apparatus take place, such as such as for example the transmission to the at least one associated detonator of a command signal to FIRE, and/or a firing code and/or a delay time, the inactive state of the blasting apparatus will present a bar to the actuation of the detonators, or the transmission of suitable signals to the detonators to cause actuation thereof. Any component or means may be utilized to achieve the inactive state. Moreover, the inactive state may be caused by passive means (for example an apparatus that remains inactive in the absence of signals to become active) or by a positive mechanism such as the shutdown or powering-down of one or more components of the apparatus.

Location Approval Component: includes any software or device capable of receiving information with regard to a location of a blasting apparatus or components thereof from one or more location assessment component, and processing this information to determine if the location is an authorized location. In preferred embodiments, a location approval component may include a memory means having a database or the like for storing approved locations for approved blasting events. In addition, a location approval component may include communication means for communicating information via electrical wires or wireless means to other components of a blasting apparatus, such as for example a decision signal to activate the blasting apparatus in response to the identification of a an approved location, or to deactivate the blasting apparatus in response to the identification of location other than an approved location for a blasting event.

Location Assessment Component: includes any software or device at or near a blast site that preferably may be associated with one or more detonators or associated components, or one or more blasting machines or associated components, at the blast site, to assess a geographical location of the detonator(s), blasting machine(s), or associated components. For example, such location assessment components may include, but are not limited to global positioning system (GPS)-like devices for obtaining geographical location information through receipt and processing of corresponding GPS satellite signals, or local positioning system (LPS)-like devices for obtaining positioning information through receipt of more locally transmitted signals such as radio signals, electromagnetic signals, audio signals or via radar. Other location assessment components may include, but are not limited to, devices that make use of cell phone wireless networks, such as devices that are able to determine a location of a nearby antenna for such a network.

Local Positioning System (LPS) Device: refers to any device or system capable of determining a geographical position through receipt of signals derived from a source relatively local to the device or system (at least when compared to signals received from satellite as for the case of GPS devices). For example, such signals may include but are not limited to, radio signals, electromagnetic signals, audio signals, or radar. Many such LPS systems are known in the art. The term "local" in "local positioning system" may encompass a device capable of receiving and processing of one or more signals derived from a source at a location remote from the device, but generally not signals received from satellites. Typically, an LPS device may permit determination of a geographical position relative to one or more other components of the system or apparatus, such as the source for the radio, electromagnetic, or audible signals. In other selected embodiments, an LPS device may simply include means to receive a signal from a remote source and relay/reflect the signal back to the source or to another form a receiver for subsequent processing (for example see United States patent publication 2005/0088335 published Apr. 28, 2005). LPS devices and systems are well known in the art for determining a position of one or more objects within a predetermined area, such as for example a building or an area of land such as a mine or a region containing one or more mines. For example, RFTechnologies produces an RFID-tag system under the tradename "Seeker". LPS devices and signals may further permit the calculation of a 2D location or a 3D location.

Logging Database: refers to any database that is suitable for storing information relating to a particular blasting event. Such information may include, for example, detonator identification information/numbers, and parameters for the blasting event, including but not limited to: a location for the blasting event, a time for the blasting event, persons present or in control of the blasting event, environmental conditions for the blasting event etc. In preferred embodiments, the logging database logs detonator destruction, most preferably in real-time or virtually in real-time via wired or wireless connection to the detonators and/or other components of the blasting apparatus. The logging database may form a component of a blasting apparatus, and be located at a blast site or at a position remote from the blast site. In selected embodiments, information corresponding to each detonator and/or selected components of the blasting apparatus may be uploaded to or downloaded from a logging database located on a portable device or logger. In selected embodiments, a logging database may be similar to those described in International patent publication WO00/60305, which is incorporated by reference.

Number of Previous Blasts: refers to a number of blasting events that previously occurred according to selected parameters. For example, a number of previous blasts may refer to a number of previous blasts within one or more specific time windows, or at a specific blast site within one or more specific time windows. Alternatively, a number of previous blasts may refer to a number of previous blasts conducted by a specific blasting apparatus, or one or more components of a blasting apparatus, or at a blast site.

Parameter: refers to any physical or informational characteristic of a blasting event that has a value that can be assigned to that blasting event. Examples of such parameters include a location for the blasting event (which value may include, but are not limited to, geographical coordinates or a location relative to another object), a time for a blasting event, or a number of previous blasts prior to the blasting event (for example at the blast site, within a predetermined time window, or for a specific blasting apparatus).

Parameter Approval Component: includes any software or device capable of receiving information with regard to a parameter of a blasting apparatus or components thereof from one or more parameter assessment components, and processing this information to determine if the parameter is within predetermined or authorized conditions for the parameter. In preferred embodiments, a parameter approval component may include a memory means having a database or the like for storing approved parameters for approved blasting events. In addition, a parameter approval component may include communication means for communicating information via electrical wires or wireless means to other components of a blasting apparatus, such as for example a decision signal to activate the blasting apparatus in response to the identification of a an approved parameter, or to deactivate the blasting apparatus in response to the identification of parameter other than an approved parameter for a blasting event. For example, such parameter approval components may include, but are not limited to location approval components, time approval components, and number of previous blasts approval components.

Parameter Assessment Component: includes any software or device at or near a blast site that preferably may be associated with one or more detonators or associated components, or one or more blasting machines or associated components, at the blast site, to assess a parameter of the detonator(s), blasting machine(s), or associated components. For example, such parameter assessment components may include, but are not limited to location assessment components, time assessment components, and number of previous blasts assessment components.

Preferably: unless otherwise indicated the term "preferably" generally precedes disclosure of one or more preferred features of the broadest embodiments of the invention as provided, such that any preferred feature is optional to most if not all embodiments of the invention, and limits only the broadest embodiments of the invention unless otherwise indicated.

Time Approval Component: includes any software or device capable of receiving information with regard to a time for a blasting event from one or more time assessment component, and processing this information to determine if the time is an authorized time for the blasting event. In preferred embodiments, a time approval component may include a memory means having a database or the like for storing approved times for approved blasting events. In addition, a time approval component may include communication means for communicating information via electrical wires or wireless means to other components of a blasting apparatus, such as for example a decision signal to activate the blasting apparatus in response to the identification of an approved time, or to deactivate the blasting apparatus in response to the identification of time other than an approved time for a blasting event.

Time Assessment Component: includes any software or device at or near a blast site or remote from a blast site, to assess a time or proposed time for actuation of the detonator(s), blasting machine(s), or associated components. In its simplest form, a time assessment component may comprise a clock, such as for example a crystal clock.

Time Window: refers to any predetermined period of time within which any selected action or actions may be induced or monitored. For example, a time window may refer to a period of time within which a number of blasting events at a blast site are counted. In another example, a time window may refer to a period of time within which a blasting event may or may not occur.

Satellite Communication Means: refers to any device capable of communication from a location on or close to the ground, with a satellite in orbit around the earth. For example such a device may form an integral part of the blasting apparatus of the invention for communicating for example with a location approval component, a time approval component, or a blast number approval component, remote from the blast site, through satellite communications. Such a device may, at least in preferred embodiments, include a satellite phone.

Wireless Communication Means: refers to any means for wireless communication between two or more components of the blasting apparatus of the invention, or between a component of the blasting apparatus of the invention and an external device, or between a component of the blasting apparatus of the invention and a detonator. Such wireless communication means may be adapted for communication via a wireless telephone network, via audio or electromagnetic signals, radio signals etc.

DETAILED DESCRIPTION OF THE PREFERRED EMBODIMENTS

The inventors have succeeded in the development of a blasting apparatus and methods of blasting that achieve significant improvements in safety and security. The inventors believe that the present invention in one aspect represents the first time that parameter assessment or approval for a blasting event has been contemplated and successfully incorporated as an integral feature of a complex blasting apparatus for use in mining operations, wherein the blasting apparatus for example comprises multiple components in communication with one another. Such parameter analysis may include, for example, an analysis of a location of the blast site, and/or a time for a blasting event, and/or a number of previous blasting events at the blast site or within a specific time period. Other aspects of the invention, which pertain to further significant improvements in safety and security of blasting apparatuses, will be apparent from a review of the present description in its entirety.

In one embodiment, the invention provides for an apparatus for controlling actuation of at least one detonator for a blasting event at a blast site, the apparatus comprising:

at least one blasting machine for transmitting command signals to said at least one detonator via direct electrical connection or wireless communication;

at least one parameter assessment component for determining a parameter for said apparatus or a component thereof;

at least one parameter approval component, for comparing said parameter with at least one approved parameter, said at least one detonator being actuatable upon receipt from said at least one blasting machine of at least one command signal to FIRE, only if said parameter and any of said at least one approved parameter correspond.

In another embodiment the invention provides for a method of controlling a blasting event at a blast site with a blasting apparatus, the blast site having positioned therein at least one detonator and associated explosive charges, each detonator being adapted to receive via direct electrical connection or wireless communication command signals transmitted or relayed by at least one associated blasting machine, the method comprising:

determining a parameter for said blasting apparatus or a component thereof;

determining whether the parameter matches at least one approved parameter, and if said parameter corresponds to at least one approved parameter then causing said at least one detonator or at least one component of the blasting apparatus to adopt or maintain an active state suitable for actuation of said at least one detonator.

In selected embodiments, specific components of the blasting apparatus of the invention, or detonators associated therewith, employ location analysis to determine whether they are located in a previously authorized location for a blasting event, and if so, to bring or maintain the blasting apparatus into an active state suitable for actuation of the detonators. In this way, if the blasting apparatus (or components thereof) fall into the hands of unauthorized blast operators such as, for example, children, operators with insufficient skill, training or experience to operate the blasting system, or terrorists, the blasting apparatus will be substantially inoperable unless within a pre-defined area or at a pre-defined location for an authorized blasting event. Since the unauthorized blast operator may not be aware of the location of an intended authorized blast site, the blasting apparatus will become inactive, or remain inactive.

The invention further provides, at least in particularly preferred embodiments, for a blasting apparatus comprising at least one location approval component to confirm that the location, and preferably also the time, of the blasting event are in accordance with at least one previously approved blasting event. In selected embodiments, the location approval component may be located remote from the blast site, to provide control and approval of the blasting event for example via wireless communication or via the internet. For example, in particularly preferred aspects each location approval component may comprise a cell phone or a computer.

The invention further provides, in other embodiments, for a blasting apparatus comprising at least one time approval component to confirm that the time of the blasting event are in accordance with the time of at least one previously approved blasting event. In selected embodiments, the time approval component may be located remote from the blast site, to provide control and approval of the blasting event for example via wireless communication or via the internet. For example, in particularly preferred aspects each time approval component may comprise a cell phone or a computer.

The invention further provides, in other embodiments, for a blasting apparatus comprising at least one blast number approval component to confirm that the number of previous blasts prior to the blasting event are less than a previously approved number of blasts, for example for a given blast site or blast apparatus, for example within a specific time window. In selected embodiments, the blast number approval component may be located remote from the blast site, to provide control and approval of the blasting event for example via wireless communication or via the internet. For example, in particularly preferred aspects each blast number approval component may comprise a cell phone or a computer.

The blasting apparatus of the present invention, at least in preferred embodiments may comprise other security features that work in conjunction with the parameter analysis means. It should be noted, however, that the blasting apparatuses of the present invention encompass any blasting apparatus designed to initiate one or more detonators at a blast site that includes some form of parameter (e.g. location and/or time and/or blast number) analysis, as well as parameter (e.g. location and/or time and/or blast number) verification to determine whether the proposed blasting event complies with required parameters (e.g. is at an approved location and/or time for blasting, and/or that a previously approved number of blasts has not been exceeded). If the presence of an authorized location and/or time is not detected, or if a previously approved number of blasts have already occurred, then the blasting apparatus will adopt or remain in some form of inactive "safe" mode, or alternatively may undergo some form of shut down or deactivation process. In preferred embodiments, the detection of an unauthorized blast location and/or time, or if a previously approved number of blasts have already occurred, this may result in the blasting apparatus maintaining an inactive "safe" state, a shut down or deactivated state for an indefinite period, or for a limited amount of time. It should also be noted that any form of location and/or time and/or blast number assessment component may be used for the purposes of determining whether a location and/or time of the blasting apparatus is an approved location and/or time, and/or that the previously approved number of blasts have not already occurred. Location assessment components may include, but are not limited to, global positioning system devices, and cell phone network devices. Time assessment components may include clocks such as quartz clocks.

In selected embodiments, the apparatus of the present invention may be used in conjunction with a system equivalent to that described by International patent publication WO00/60305, which is incorporated by reference. This system allows for the logging of authorized detonator usage of identifiable detonators, after removal of the detonators from a controlled store. As such, a firing control station monitors and logs the actuation of each detonator after transmission thereto of a FIRE signal. The inventors contemplate, at least in preferred embodiments, the combination of the apparatus of the present invention with a system the same or similar to that described by WO00/60305. In this way, the time of the detonator firing, the nature of the material being actuated, and the location of the blasting event, can be centrally monitored, and the information stored accordingly for future reference.

The invention encompasses blasting apparatuses and methods for controlling detonators that are each identifiable by a unique identification code. In preferred embodiments, each detonator or group of detonators may be controlled on an individual or group basis, and programmed with unique firing codes for security purposes, or delay times to ensure a predetermined firing sequence is properly effected upon receipt of the detonators of a command signal to FIRE. In summary, providing each detonator with a unique identification code allows for any one or more of the following: individual control of each detonator by other components of the blasting apparatus, individual programming of each detonator with delay times, individual programming of each detonator with one or more firing codes for security purposes, and individual logging of the control and/or use of each detonator at a blast site. Any of the blasting apparatus and methods of the invention may involve the use of detonators that include identification codes for any one or more of the described purposes.

Further selected embodiments of the invention relate to the incorporation of biometric devices into specific components of the apparatus of the present invention. In this way, and preferably in conjunction with the features outlined in WO00/60305, the inventors contemplate the provision of a blasting apparatus that will allow monitoring and recordal of the following information for the firing of each identifiable detonator: what was fired, when, where, and by whom. All such information may be transmitted via any means (including wireless means) to a centralized monitoring facility and database.

Additional aspects and embodiments of the present invention will become apparent from the specification in its entirety.

Turning now to FIGS. 1 to 9, it should be noted that the embodiments illustrated and described below discuss blasting apparatuses and corresponding methods that employ the use of a location assessment component, and a location approval component, for determining whether one or more components of a blast apparatus for a blasting event are located at an approved location for a blasting event. In most if not all of the embodiments illustrated the location assessment component and the location approval component may be replaced with a time assessment component and a time approval component respectively in order to determine whether a time for a blasting event is an approved time. Alternatively, in most if not all of the embodiments illustrated the location assessment component and the location approval component may be replaced with a blast number assessment component and a blast number approval component respectively, in order to determine whether a number of approved blasts for a given apparatus, time period or blast site has already been exceeded.

A preferred embodiment of the apparatus of the present invention will now be described with reference to FIG. 1. A blasting apparatus shown generally at 10 is schematically illustrated. The blasting apparatus comprises at least one blasting machine 11 (for simplicity only one blasting machine is shown), connected via a trunk line 12 and branch lines 13 to a plurality of detonators 20. In several of the embodiments described herein each blasting machine 11 is connected to detonators 20 via a trunk line 12 and branch lines 13. However, any means for connecting the blasting machine to the detonators may be used in any embodiment of the invention, providing that command signals can be communicated to the detonators from each blasting machine in order to control and optionally actuate the detonators. For example, communication may involve the use of low energy detonating cord (LEDC), shock tube, electrical wires, or wireless communication means. Moreover, each detonator may be adapted for receipt of command signals via LEDC, shock tube or electric wires, or alternatively may form a component of a wireless detonator assembly for receipt of wireless command signals from at least one blasting machine. Such wireless detonator assemblies may form a network of wireless detonator assemblies, as disclosed for example in U.S. patent application 60/623,941 filed Nov. 2, 2004, which is incorporated herein by reference.

The blasting apparatus illustrated in FIG. 1 further includes a location assessment component 14 for determining a location for the blast site, or at least for selected components of the blasting apparatus at or near to the blast site. The location assessment component 14 may take any form of device capable of determining independently, via communication with other components of the blasting apparatus, or via communication with other external devices, its geographical position or location. In this way, the apparatus may become 'informed' as to its location. In preferred embodiments, the location assessment component may comprise a global positioning system (GPS) device capable of calculating its geographical coordinates at least in part through receipt of one or more GPS satellite signals. GPS systems for determining geographical location are well known in the art, and any such device may be incorporated into the apparatus of the present invention. In other preferred embodiments, the location assessment device may comprise an LPS device, capable of receiving signals from a source more local than a satellite. In other preferred embodiments, the location assessment component may comprise a cell phone network connection means comprising any device capable of making a connection to a cell phone network operating in the vicinity of the blast site. In this way, the cell phone network connection means may have the capacity to determine a location of the device by identifying one or more antenna or receivers used by the device to connect to the cell phone network. Since the geographical locations for most if not all antennae of cell phone networks are known with some degree of accuracy, this information may permit the location assessment component (or at least the user of the blast apparatus) to determine a geographical location for the device. For example, if the cell phone network connection device connects to the cell phone network via two or more identifiable antennae, then the geographical location of the location assessment component can be calculated with greater accuracy for example via triangulation techniques. Even if the cell phone network connection means connects to the cell phone network via only one antenna, then the geographical location of the location assessment component can still be calculated with some degree of accuracy on the basis of the range of the antenna.

The location assessment component 14 is further capable of transmitting positional data 16 regarding the location of the location assessment component to a location approval component 15. The location approval component may comprise any device capable of receiving and processing the positional data from the location assessment component so as to determine whether the geographical location of the location assessment component corresponds with an authorized blasting location. For example, the location approval component may be pre-programmed with one or more approved locations approved by an appropriate authority for blasting events. Such an appropriate authority may include, for example, an authorized blast operator, an authorized mine operator, an authorized person at an office for the blasting equipment An appropriate authority would generally not include an unauthorized blast operator such as a child or a terrorist. Upon receiving the positional data 16 regarding geographical location of the location assessment component 14, the location approval component 15 compares the positional data with stored data pertaining to approved locations for blasting events.

If the location approval component 15 finds a match between the geographical location of the location assessment component, and an approved location, then the location approval component may take one or more additional steps to ensure that the blasting apparatus adopts or maintains an active state suitable for actuation of the detonators 20 upon receipt thereby of one or more appropriate command signals from the blasting machine 11. If the blasting apparatus is already in an active state suitable for actuation of the detonators 20, the additional steps may involve little or no action other than to maintain the active state. On the other hand, if the blasting apparatus exists in a dormant, inactive, or powered down state then the additional steps may involve activation of the blasting apparatus or components thereof to bring the apparatus into an active state for blasting. This active state may be maintained indefinitely, or may be maintained for a limited time period or window.

If the location approval component 15 fails to find a match between the geographical location of the location assessment component, and an approved location, or if the location approval component determines that the geographical location is a forbidden location for blasting, then the location approval component may take one or more additional steps to ensure that the blasting apparatus adopts or maintains an inactive state unsuitable for actuation of the detonators 20. If the blasting apparatus is already in an inactive state unsuitable for actuation of the detonators 20, the additional steps may involve little or no action other than to maintain the inactive state. On the other hand, if the blasting apparatus exists in an active state then the additional steps may involve deactivation, or shutdown of the blasting apparatus or components thereof to bring the apparatus into an inactive state unsuitable for initiating the blasting event. This inactive state may be maintained indefinitely, or may be maintained for a limited time period or window.

The capacity of the location approval component to determine whether the geographical location is an approved location for blasting may cause the location approval component to generate a decision signal, wherein a positive decision signal indicates a positive match for blasting, and a negative decision signal indicates the absence of a positive match for blasting. The decision signal may be transmitted by the location approval component 15 to other components of the blasting apparatus to bring about the maintenance or a change in the status of the blasting apparatus. For example, the location approval component 15 may transmit a decision signal 17 to the blasting machine 11 to cause activation thereof in response to a positive decision signal, or shutdown thereof in response to a negative decision signal. In this way, the functionality of the blasting apparatus may be controlled at the level of blasting machine, and its capacity to transmit or relay command signals to the detonators. Alternatively, the location approval component 15 may transmit a decision signal 18 directly to the one or more detonators 20 (or associated assemblies) to cause activation thereof in response to a positive decision signal, or shutdown thereof in response to a negative decision signal. In this way, the functionality of the blasting apparatus may be controlled at the level of the detonators, such that the capacity of the detonators to receive and/or respond to command signals from the blasting machine may be overridden by the decision signal.

In yet another alternative example, the location approval component may transmit a decision signal 19 to the location assessment component 14, which in this example may be in communication 21 with either the blasting machine 11, and/or in communication 22 with the detonators 20, thereby to cause activation or shutdown of the blasting machine and/or the detonators as required by the decision signal. In any event, communication 19 of the decision signal to the location assessment component 14 effectively causes the location assessment component 14 to function as a relay for the decision signal to other components of the blasting apparatus. As discussed in more detail later, specific embodiments of the invention contemplate the positioning of the location assessment component 14 with components at or in the direct vicinity of the blast site, such as for example in connection with the blasting machine 11 or one or more of the detonators 20, with the location approval component 15 at a remote location. Therefore the use of the location assessment component 14 to relay a decision signal to the blasting machine 11 or one or more of the detonators 20 may present a particularly preferred feature of the invention under these circumstances.

FIG. 1 illustrates another preferred feature of the invention with regard to the function of the location approval component 15. The database 23 may form an integral component of the location approval component for storing data relevant to approved locations for blasting. In this way the database is checked by the location approval component to assess whether the geographical location corresponds with any approved locations in the database. Preferably, the database is secure such that access to and modification of the database may be achieved only by an authorized blast operator. For example, the database may be arranged such that a password or biometric verification is required for access.

Figure 2:
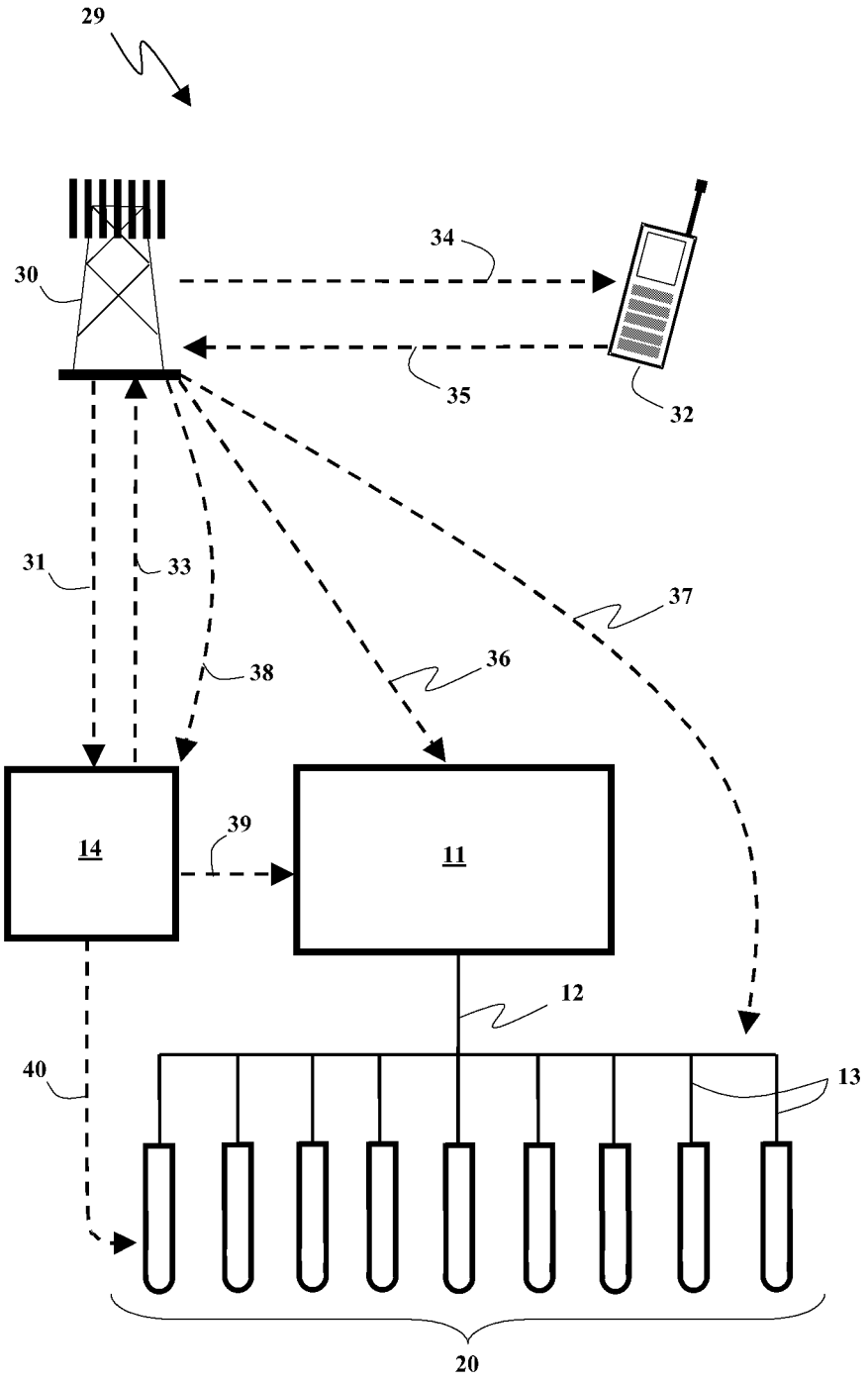
FIG. 2 illustrates a preferred blasting apparatus of the invention.

Turning now to FIG. 2, the blasting apparatus 29 includes a blasting machine 11 connected via lines 12 and 13 to detonators 20. The blasting apparatus further includes a location assessment component 14. However, in this embodiment, location assessment component 14 is a cell phone network connection means, which can receive signals transmitted from, and optionally send signals to, an antenna 30 of a cell phone network. For example, the cell phone network connection means may receive a wireless signal 31 from the antenna 30 comprising information regarding the geographical position of the antenna 30. This in turn with provide an approximate location of the location assessment component 14, since the antenna 30 will have a limited range of, for example, several kilometers. Although not shown in FIG. 2, the location assessment component 14 may connect to two or more antenna of a cell phone network, and upon receiving wireless signals from each of the two or more antenna the location assessment component may calculate a more accurate geographical location, for example via triangulation or other similar techniques known in the art.

FIG. 2 illustrates another preferred feature of the invention. The location approval component (illustrated as 15 in FIG. 1) now takes the form of cell phone 32, which is able to communicate signals to or from the other components of the blasting apparatus via use of the cell phone network and corresponding antenna 30. For example, location assessment component 14 may receive information 31 from antenna 30 sufficient to allow location assessment component 14 to determine its geographical position, or at least its approximate geographical position. Subsequently, this information may be relayed to cell phone 32 via antenna 30 as shown by signals 33 and 34. In its role as location approval component, the cell phone 32 may receive and process the information from the location assessment component 14 regarding the geographical location. For this purpose, the cell phone 32 may have pre-programmed therein one or more approved locations for blasting events. The cell phone then compares the geographical location information received from the location assessment component 14 with the pre-programmed approved locations for blasting. If a match is found, indicating the geographical location is approved for a blasting event, then the blasting apparatus is caused to adopt or maintain an active state suitable for actuation of the detonators 20 upon receipt thereby of appropriate command signals from blasting machine 11. On the other hand, if no match is found, or if the geographical location is determined to be a forbidden location for a blasting event, then the blasting apparatus is caused to adopt or maintain an inactive state unsuitable for actuation of detonators 20.

Any means may be used by the cell phone or other components of the blasting apparatus to achieve a change in status, or maintenance of status, of the blasting apparatus. For example, cell phone 32 may forward a decision signal 35 to other components of the blasting apparatus and/or the detonators. This decision signal may be relayed to such other components and/or the detonators in various ways. The decision signal may be transferred directly to the blasting machine 11 via wireless signal 36, or directly to the detonators 20 via wireless signal 37, to cause activation or deactivation thereof as previously described. Alternatively, the decision signal may be transferred to the location assessment component 14 via wireless signal 38 (indeed this embodiment may be preferred since location assessment component 14 may already comprise means to receive wireless signals from antenna 30 for determining the geographical location). Location assessment component 14 may then relay the decision signal via wired or wireless connections 39 (to the blasting machine 11) and/or via wired or wireless connection 40 (to the detonators 20).

With continued reference to FIG. 2, it should be noted that the position of cell phone 32 relative to other components of the blasting apparatus is irrelevant, providing that communication lines are maintained. For example, cell phone 32 may be in the direct vicinity of the blast site, such that signals 34 and 35 comprise wireless signals directed to antenna 30. On the other hand, cell phone 32 may be located remote from the blast site, even in a different country or continent from the blast site. As such, signals 34 and 35 may be transmitted to the cell phone 32 via wireless and/or land line connections such that cell phone 32 may be replaced by a non-wireless device such as a suitably programmable telephone or computer (similar embodiments are described below with reference to FIGS. 3 and 4).

Figure 3:
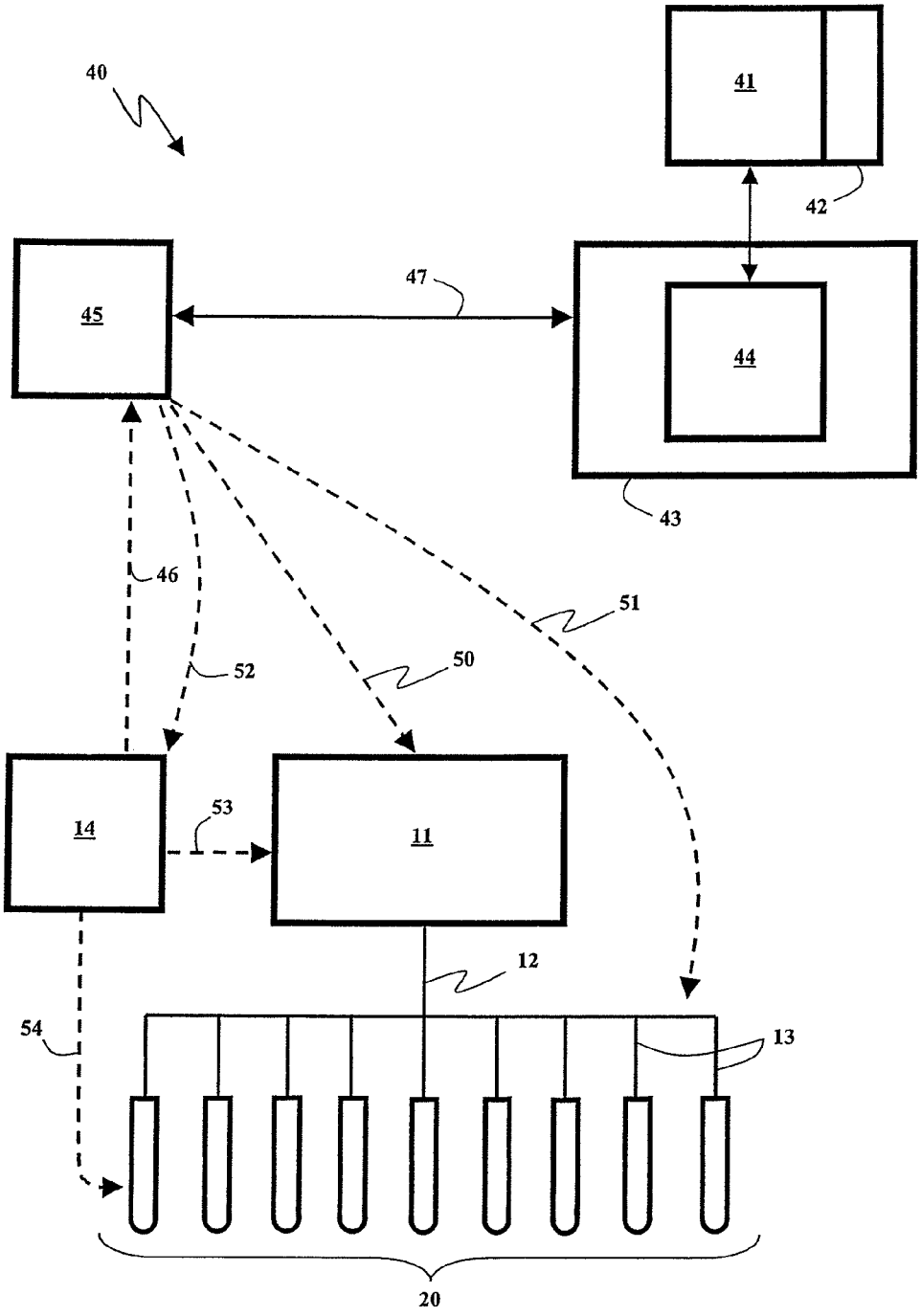
FIG. 3 illustrates a preferred blasting apparatus of the invention.
Figure 4:
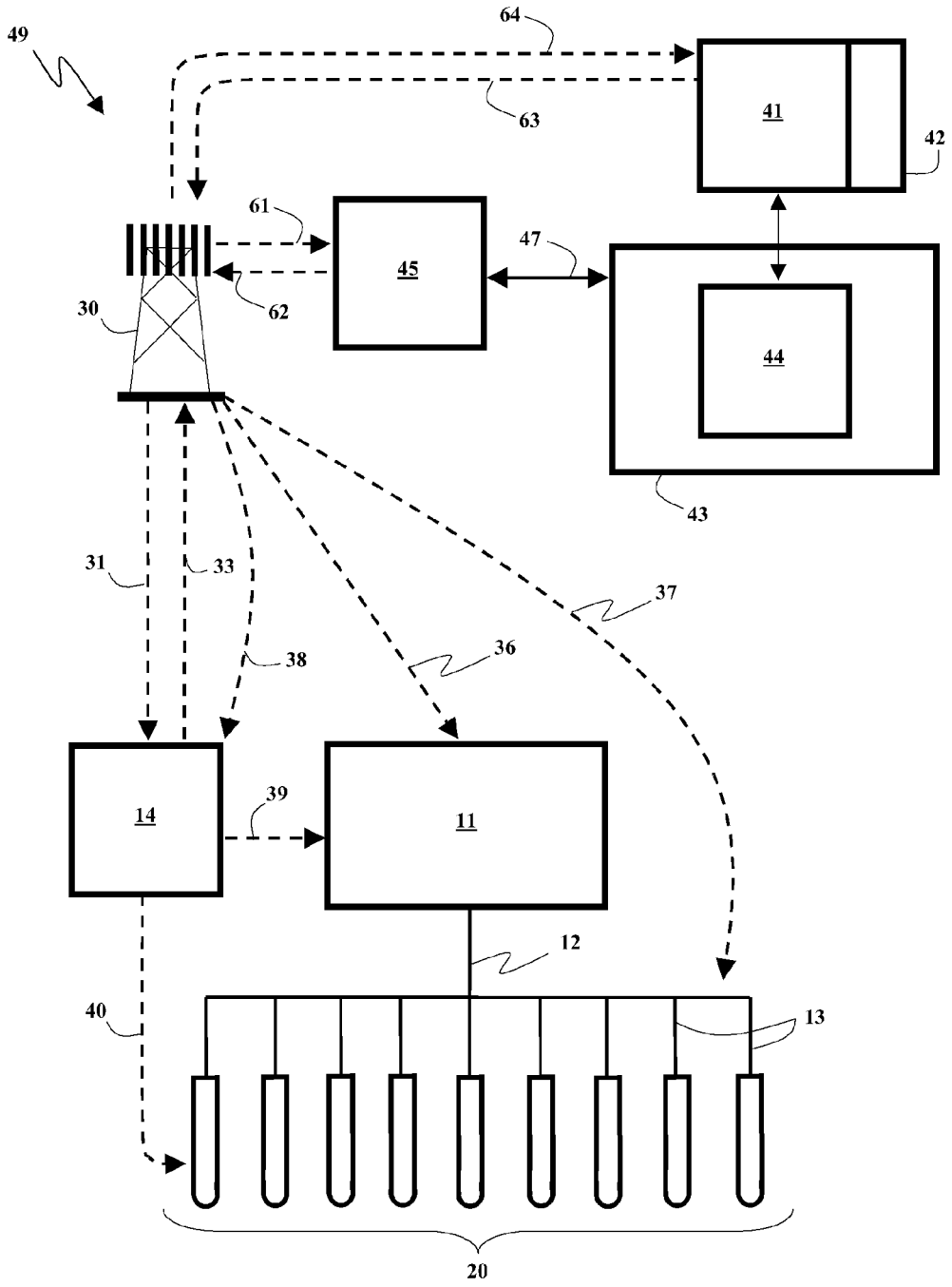
FIG. 4 illustrates a preferred blasting apparatus of the invention.
Figure 5:
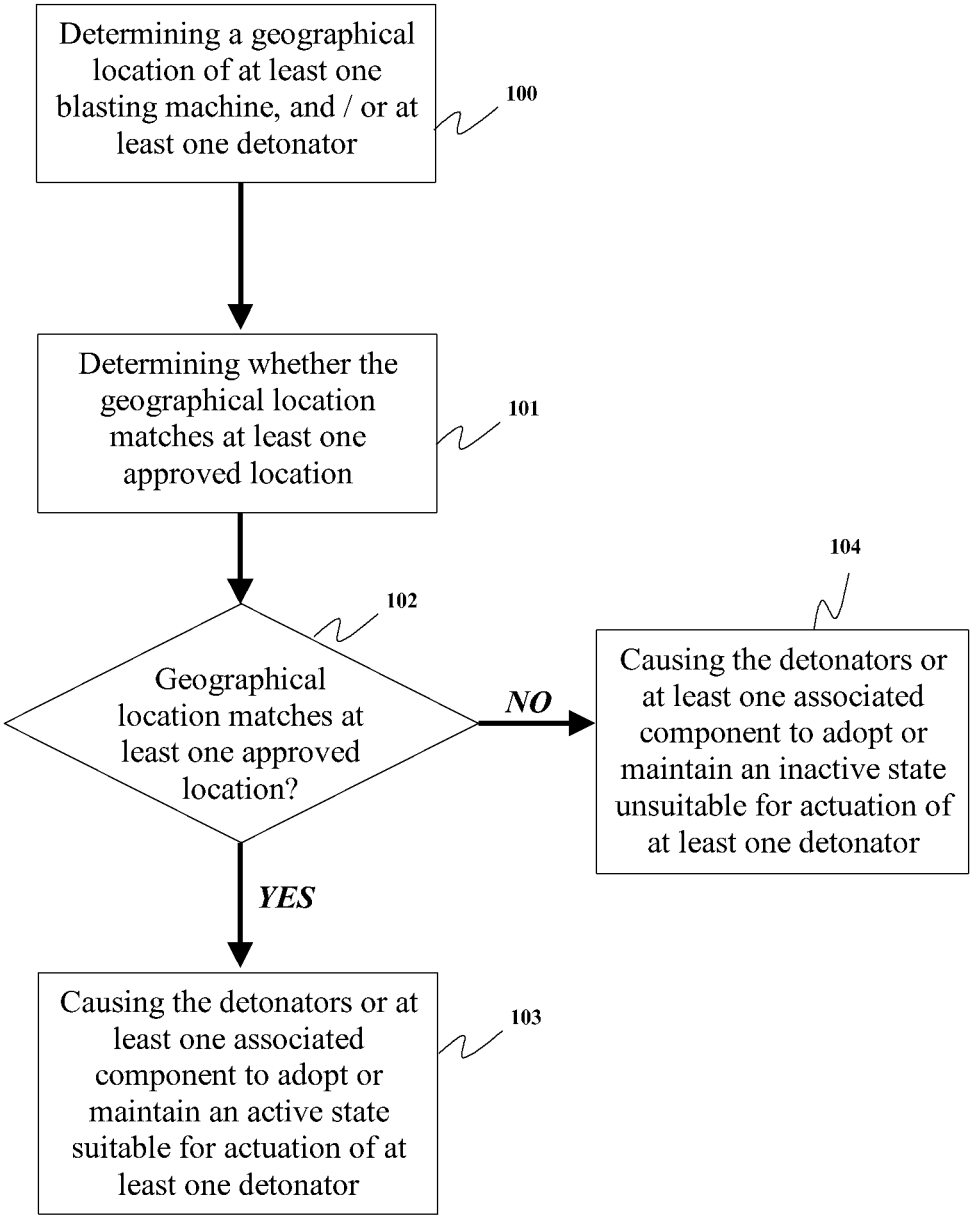
FIG. 5 illustrates a preferred method of the invention.

Turning now to FIG. 3, a further embodiment of a blasting apparatus of the invention is illustrated. The blasting apparatus shown generally at 40 includes a blasting machine 11 connected via lines 12 and 13 to detonators 20. The blasting apparatus further includes a location assessment component 14. In contrast to the embodiment illustrated in FIG. 2 the location approval component 15 in this embodiment is provided by computer 41. An optional feature is indicated in FIG. 4 in association with or as an integral part of computer 41, in the form of database 42 for storing therein pre-programmed information regarding approved locations for blasting events. The computer 41 receives information from the location assessment component 14 via an interface, which in FIG. 3 comprises the internet 43. For example, the computer 41 may communicate with location assessment component 14 via an email or website-based interface 44. The information pertaining to the geographical data may be derived by any technique including GPS calculations, or by virtue of a known location for a local server 45 used for communication between the location assessment component and the Internet. In any event, the information regarding the geographical location of the location assessment component 14 may be uploaded 46 to the server 45 as necessary, either through wired or wireless communication. Subsequently, the server 45 may transfer 47 the data for the geographical location to the internet 43 such that the computer 41 can access the data via email or website 44. The computer 41 may compare the information for the geographical location with stored information for authorized locations for blast events to determine whether the location assessment component is located at an authorized blast site.

In other respects, the embodiment is similar to that illustrated with reference to FIG. 2, except that a server and the internet are responsible for providing the interface between the location approval means (i.e. the computer 41) and the remaining components of the blasting apparatus. As illustrated in FIG. 3, if necessary the server 45 may transmit via wired or wireless communication a decision signal to one or more of the other components of the blasting apparatus. For example, in a similar manner to the antenna in FIG. 2, the server 45 may transmit the decision signal either to the blasting machine 11 via signal 50, and/or to the detonators 20 via signal 51. Alternatively, the server 45 may transmit the decision signal to the location assessment means 14 via signal 52, for relay to the blasting machine 11 via signal 53, and/or relay to the detonators via signal 54.

Turning now to FIG. 4, a particularly preferred embodiment of the blasting apparatus (shown generally at 49) of the invention is illustrated, which includes components from the embodiments described with reference to FIG. 2 and FIG. 3. In FIG. 4, the location assessment component 14 determines a geographical position of the blast site via wireless communication 31, 33 with antenna 30. Moreover, the decision signal is transmitted preferably via wireless means from the antenna 30 to the detonators 20 and/or any one or more components of the blasting apparatus including, but not limited to, the blasting machine 11 and the location assessment means 14. Therefore, in all respects thus far described, the embodiment illustrated in FIG. 4 is similar to that shown in FIG. 2. However, in FIG. 4 the location approval component comprises computer 41, which preferably includes database 42.

The interface between computer 41 and location assessment component 14 therefore includes antenna 30, but in other respects may vary, and in FIG. 4 two alternative options are presented. In one option, the overall interface is similar to that illustrated in FIG. 3, and comprises the internet 43 including an email or website component 44, and a server 45. However, in FIG. 4 the server 45 is adapted for two-way communication 61, 62 either via wired or wireless connections with antenna 30. Effectively, the computer 41, which functions as location approval means 15, may be positioned as required in communication with the internet either near to the blast site or remote from the blast site, even in a different country or continent. Regardless of the position of the computer 41, the location assessment component 14, the blasting machine 11, and the detonators 20 at the blast site may be positioned as desired for the blast event, without the need for wired communications to the location approval component 15 or other components of the blasting apparatus remote from the blast site. In addition, it is worth noting that the antenna in the embodiment shown in FIG. 4 fulfils two key roles: (1) it permits assessment of the geographical location of the blast site, and (2) it provides wireless internet access for the components of the blasting apparatus located at the blast site.

As mentioned above, FIG. 4 further illustrates another option for the interface between the computer 41 and the location assessment means 14. Specifically, there remains the option for direct two-way wireless or wired communication 63, 64 between the computer 41 and antenna 30 for the purposes of transferring information relating to the geographical location to the computer, and for transferring a decision signal from the computer to other components of the blasting apparatus via the antenna. Although not illustrated, the invention further encompasses the use of a communication link between the computer 41 and other antenna not in the vicinity of the blast site, such that transfer of data to and from the computer and the blast site occurs via the cell phone network generally without use of the internet.

The invention further provides various methods of controlling a blasting event at a blast site. For example, in one selected embodiment shown in FIG. 5, the invention provides a method of controlling a blasting event at a blast site having positioned therein at least one detonator and associated explosive charges, each detonator being adapted to receive via direct electrical connection or wireless communication command signals transmitted or relayed by at least one associated blasting machine, the method comprising:

a step 100 of determining a geographical location of said at least one blasting machine, and/or said at least one detonator;

a step 101 of determining whether the geographical location matches at least one approved location, and only if said geographical location matches at least one approved location at step 102 then conducting a step 103 of causing said at least one detonator or at least one associated component to adopt or maintain an active state suitable for actuation of the detonators. If said geographical location does not match any of the at least one approved location at step 102 then conducting a step 104 of causing the at least one detonator or at least one associated component to adopt or maintain an inactive state unsuitable for actuation of the at least one detonator. Although not specified in FIG. 5, the method described may involve any apparatus or components in order to achieve the desired steps. Such components may communicate with one another in any possible way to achieve the desired steps.

In particularly preferred embodiments, the methods of the present invention involve the use of an apparatus of the present invention. For example, as illustrated with reference to FIG. 6, another embodiment of the invention involves a method of controlling at least one detonator at a blast site using any embodiment of the apparatus of the invention, the method comprising the steps of:

a step 110 of determining via the at least one location assessment component of the apparatus a geographical location of said at least one blasting machine, and/or said at least one detonator;

a step of 111 of determining via the location approval component of the apparatus whether the geographical location matches any of at least one approved location; and only if said geographical location matches at least one approved location at step 112 then conducting a step 113 of causing said apparatus to adopt or maintain an active state suitable for actuation of said at least one detonator upon receipt thereby from said at least one blasting machine of at least one command signal to FIRE. If said geographical location does not match at least one approved location at step 112 then conducting a step 114 of causing said apparatus to adopt or maintain an inactive state unsuitable for actuation of said at least one detonator.

In accordance with any method of the invention, any communication means may be used between components of the blasting apparatus, and/or the detonators. Such methods include wired and wireless communication means. In this way, the components used to carry out the methods may be relatively close or remote from one another.

The methods may employ GPS, LPS, cell phone, or any other form of technology in order to determine a geographical location, for example by a location assessment means. In addition, the location approval means, as used in accordance with the methods of the invention, may involve the use of cell phone technology and/or the internet in order to determine whether the geographical location is an approved location.

The methods of the invention may further employ the use of a central command station located remote from the blast site to generate and transmit at least one command signal to the at least one blasting machine, and if the at least one command signal includes a command signal to FIRE, and if the apparatus adopts or maintains the active state, the at least one blasting machine relaying the command signal to FIRE to the at least one detonator to cause actuation thereof. In specific methods of the invention the location approval component may be in association with, and direct electrical communication with, said central command station, and may activate or deactivate the central command station as determined by whether a match is found for the geographical locations.

Figure 6:
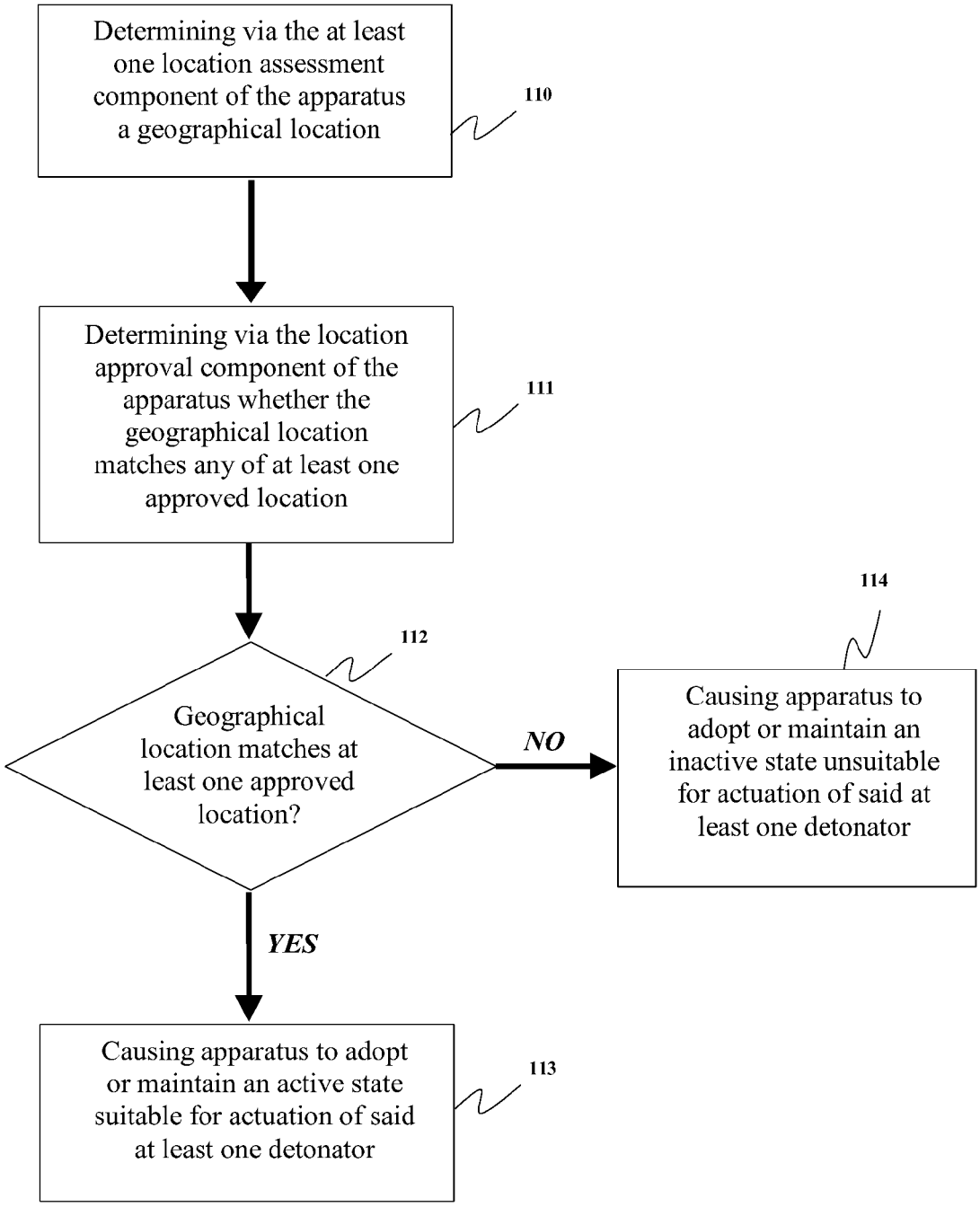
FIG. 6 illustrates a preferred method of the invention.
Figure 7:
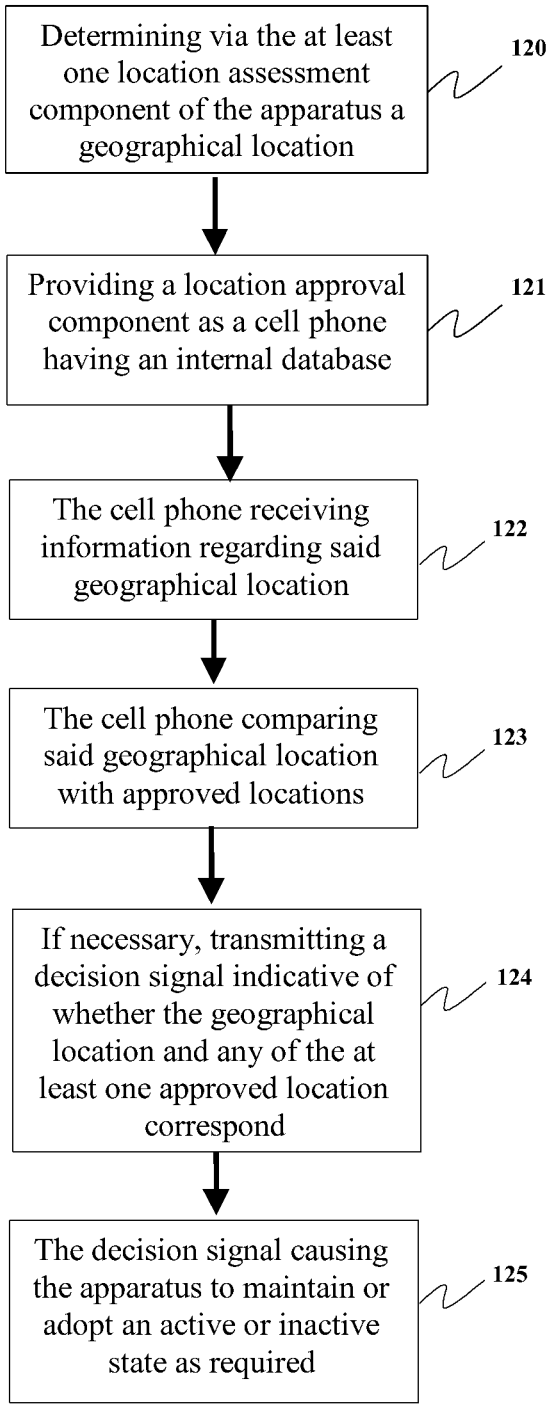
FIG. 7 illustrates a preferred method of the invention.

Turning now to FIG. 7 there is illustrated another method of the invention that utilizes an apparatus of the invention. Step 120 comprises determining a geographical location for at least one blasting machine and/or the at least one detonator. However, in this embodiment the least one location approval component is provided 121 as a cell phone having an internal database having stored therein the at least one approved location and being in wireless communication with the at least one location assessment component, either directly or via at least one antenna of a cell phone network. Step 112 in FIG. 6 is effectively replaced by steps 122, 123, and 124 in FIG. 7. Step 122 comprises receiving information derived from at least one associated location assessment component regarding said geographical location. Step 123 comprises comparing the geographical location with the internal database. Step 124 involves, if necessary, transmitting a decision signal indicative of whether the geographical location and any of the at least one approved location correspond, to one or more other components of the apparatus, and if the geographical location and any of said at least one approved locations correspond, the decision signal at step 125 causing the apparatus to maintain or adopt said active state. Preferably, the decision signal may be relayed via the at least one antenna, and processed by the at least one location assessment device and/or the at least one blasting machine and/or said at least one detonator, thereby to selectively activate or deactivate components of the apparatus. More preferably, each of the at least one location assessment component comprises a cell phone network connection means for connecting to said cell phone network via at least one antenna at or near to a vicinity of the blast site, and wherein the step of determining a geographical location comprises analyzing a known geographical location for each of said at least one antenna. Alternatively, each location assessment component may comprise a GPS device or an LPS device in association with at least one detonator and/or at least one blasting machine.

Although FIG. 7 illustrates the use of a cell phone as a location approval component, a computer can also be used either in direct or wireless communication with each location assessment component, or via the internet. Such concepts are previously described with reference to the apparatuses of the present invention. Indeed, in particularly preferred embodiments of the invention, the methods may encompass the use in combination of a cell phone network for wireless communication between components of the blasting apparatus, as well as the internet for obtaining location approval.

Figure 8:
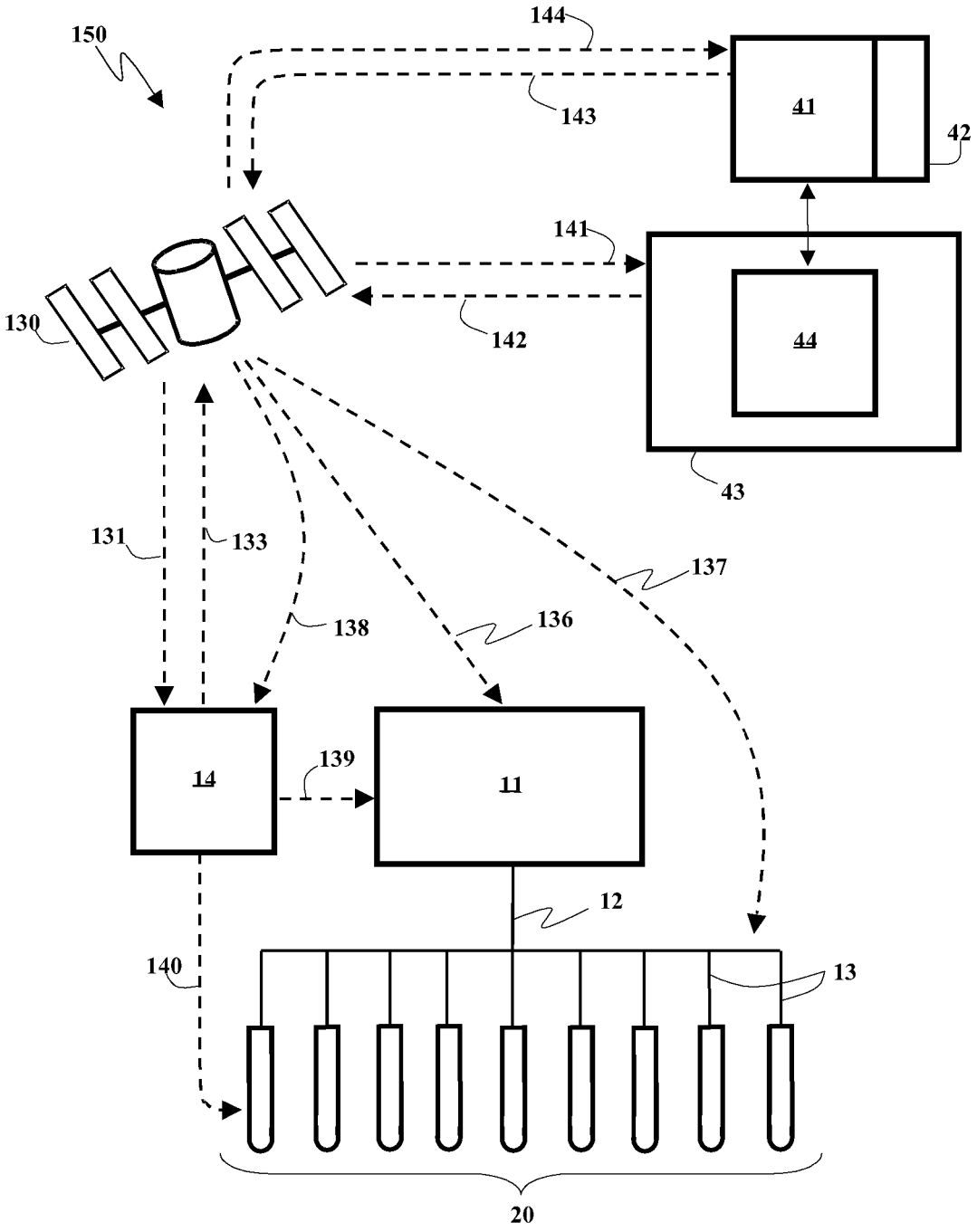
FIG. 8 illustrates a preferred blasting apparatus of the invention
Figure 9:
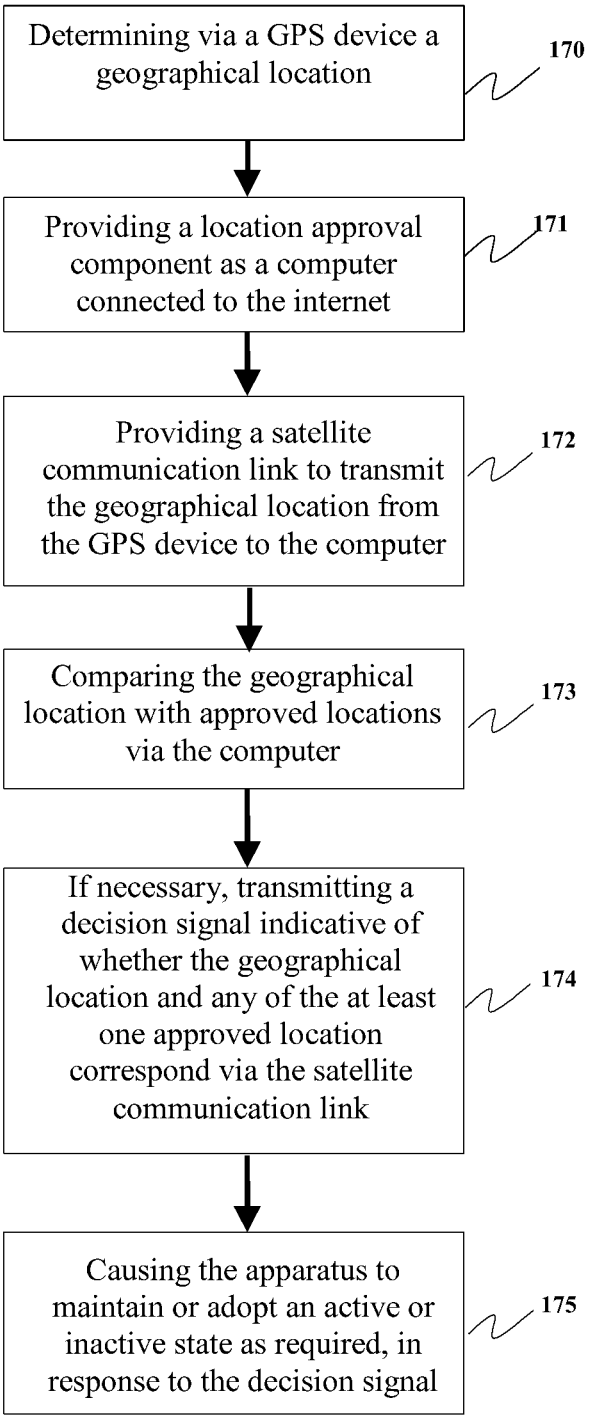
FIG. 9 illustrates a preferred method of the invention.

FIGS. 8 and 9 illustrate a further apparatus and corresponding method of the present invention respectively, which involve the use of satellite communication for the purposes of location assessment and location approval. The embodiments described with reference to FIGS. 8 and 9 are particularly suited for use when the location of the blast site is very remote, for example beyond the range of cell phone or wire-based telephone networks. In FIG. 8 there is illustrated an apparatus shown generally at 150. The apparatus includes at least one blasting machine 11 in communication via lines 12 and 13 with a plurality of detonators 20. The apparatus further includes a location assessment component 14 which receives from satellite 130 GPS satellite signals 131. Since the location assessment component of the apparatus is located generally at the blast site the receipt and processing of the GPS signals generally allows the location assessment component to pinpoint or at least closely pinpoint a geographical location for the blast site.

The apparatus further comprises computer 41 which forms, at least in part, the location approval component of the apparatus. The computer 41 may be located in a position remote from the blast site, for example in a different country from the blast site. The computer 41 may communicate with the location assessment means via satellite communication involving any feasible route. For example the computer may include means (not shown) for directly beaming satellite communication signals to 143 or from 144 a suitable satellite 130. Alternatively, the computer may communicate with the satellite via the internet 43, and satellite signals 141 and 142.

In FIG. 8, the location assessment component 14 transmits a signal 133 to the satellite 130 comprising information relating to the geographical location of the location assessment component. The satellite, following receipt of signal 133, may communicate the geographical location information directly to the computer 41 via signal 144, or alternatively via signal 141 and the internet 43. In any event, the computer 41 receives the information regarding the geographical location and can compare this information with approved locations for blasting stored for example in an internal database 42, or on a website 44 on the internet. If a match is detected indicating that the geographical location is an approved location for blasting then the computer 41, if required transmits a decision signal to the satellite 130 either directly 143 or via the internet 43, 142. The satellite 130 then relays the decision signal to any one or more components of the blasting apparatus at the blast site such as the blasting machine 11 via signal 136 or the location assessment component 14 via signal 138. The location assessment component in turn may transmit the decision signal to the blasting machine 11 via signal 139, or alternatively the detonators via signal 140. Alternatively, the satellite may transmit the decision signal directly to the detonators via signal 137. In any event, the decision signal once received by the detonators and/or one or more components of the apparatus at the blast site will cause activation or deactivation of the apparatus and/or the detonators as required.

Although FIG. 8 illustrates location assessment component 14 communicating a signal to the satellite 130 via signal 133, it will be appreciated that this communication may also occur via blasting machine 11 and/or via a central command station (not shown). In this way, any of the components of the apparatus at the blast site may be equipped with means to transmit signals to, and receive signals from, satellite 130. Such means may include, but not are limited to, a satellite phone or similar device capable of sending signals to and receiving signals from a satellite without need for external support.

In the embodiment illustrated in FIG. 8 the same satellite 130 is used for the purposes of location assessment via GPS means, as well as for signal communications between the components of the apparatus at the blast site (e.g. the location assessment component 14), and the components remote from the blast site (e.g. the computer 41). However, it will be appreciated that a single satellite is illustrated for simplicity, and two or more satellites may be involved in performing any one or more of these required functions.

FIG. 9 illustrates a method of the present invention, which corresponds to the use of the apparatus illustrated in FIG. 8. In step 170 of the method, a geographical location of one or more components at a blast site are determined via a GPS device receiving GPS signals from a suitable satellite in orbit about the earth. In step 171 there is provided a computer located for example remote from the blast site, which forms at least in part the location approval component of the apparatus. In step 172, a satellite communication link is established between the location assessment component and the computer so that the information regarding the geographical location can be transmitted from the location assessment component to the computer. This communication link may take any form that in part involves satellite communication. For example the communication link may further involve use of the internet to transmit the relevant information regarding the geographical location.

In step 173 the computer compares the geographical location with known approved locations for blasting events. This comparison may be conducted in an internal database for the computer, or alternatively may involve an external database accessed for example via the internet. Once the computer has determined whether a match exists between the geographical location and an approved geographical location, a corresponding decision signal may be transmitted, if necessary, in step 174 to the detonators and/or one or more other component of the blasting apparatus located at the blast site, thereby to activate or deactivate the apparatus as required in step 175. Such communication of the decision signal at step 174 occurs at least in part via satellite communication.

Any of the embodiments of the apparatuses and methods encompassed by the present invention, including any of the embodiments described with reference to FIGS. 1 to 9, may include a time assessment component and a time approval component, in replacement of (or in addition to) a location assessment component and a time approval component respectively. In this way, the present invention further provides for blasting apparatuses and methods that involve an assessment of whether a proposed time for a selected blasting event matches a pre-approved or previously authorized time for the blasting event. The time assessment component determines a time or a proposed time at which a blasting event (including actuation of detonators) is to be initiated, which is transmitted to a time approval component. The time approval component then compares the time for the blasting event with one or more approved times or time windows for blasting event. If the proposed time for the blasting event matches a previously approved time, or falls within a previously approved time window, then the blasting apparatus may be caused to adopt or maintain an active state suitable for actuation of at least one detonator at the blast site in communication with one or more components of the blasting apparatus. On the other hand if the proposed time for the blasting event does not match any previously approved times, or does not fall within a previously approved time window, for a blasting event, then the blasting apparatus is caused to adopt or maintain an inactive state unsuitable for actuation of the at least one detonator.

The blasting apparatuses and methods of the invention that involve a time assessment component and a time approval component may include any form of cross communication between the time assessment component, the time approval component and any other components of the blasting apparatus, other devices, and/or associated detonators. For example, such communication may involve wired communication, or wireless communication involving for example cell phone networks or satellite communication as previously described with reference to FIGS. 1 to 9 and other embodiments of the invention. These embodiments may further, as required, involve the use of a cell phone or a computer as at least part of a time approval component, which may optionally include communication or data analysis or retrieval via the internet.

The blasting apparatuses and methods of the invention that involve a location assessment component and a location approval component often, but not necessarily, require that the location assessment component be located at or near the blast site so that the geographical location of the blast site can be determined. The positioning of the location approval component, on the other hand, is more flexible, and this component may be location at or near the blast site, or remote from the blast site. In contrast, a time assessment component and a time approval component may both be located at any position providing that communication is generally maintained with one or more components of the blasting apparatus at the blast site, and/or the detonators at the blast site. For example, the time assessment component and the time approval component may be incorporated into a single device or "box" location at or near the blast site. Alternatively, time assessment component and the time approval component may be located far from the blast site, such as for example in a different country, such that communication with the blast site is for example maintained at least in part via a radio link, cell phone communication, satellite communication or the internet.

Any of the embodiments of the invention that involve a time assessment component and a time approval component may further include, at least in preferred embodiments, a location assessment component and a location approval component for determining whether a location of the blast site is an approved location for blasting, and/or a blast number assessment component and blast number approval component (see below) for determining whether a number of blasts within a given time period is within an approved number of blasts. In this way, the invention encompasses blasting apparatuses and corresponding methods employing such blasting apparatuses that determine whether a particular blasting event matches an approved location and time for blasting, and/or whether a number of blasts, for example, within a given time period is within an approved number of blasts.

Other embodiments of the invention include the use of a blast number assessment component and a blast number approval component in replacement of or in addition to a location/time assessment component and a location/time approval component. The blast number assessment component may simply count a number of blasting events conducted, preferably within a given blast apparatus and/or preferably for a given time period for one or more blast apparatuses and/or for a particular blast site, and transfer this information to a blast number approval component. The blast number approval component, upon receipt of information regarding the number of blasting events, compares the number of blasting events with an approved number of blasting events for the blasting apparatus and/or the given period and/or the blast site. If the number of blasting events matches or is less than an approved number of blasting events, then the blast number approval component optionally transmits a decision signal to the detonators and/or one or more components of the blasting apparatus to cause the detonators and/or the blasting apparatus to adopt or maintain an active state suitable for actuation of the detonators. On the other hand, if the number of previous blasting events is equal to or exceeds an approved number of blasting events, then the blast number approval component optionally transmits a decision signal to the detonators and/or one or more components of the blasting apparatus to cause the detonators and/or the blasting apparatus to adopt or maintain an inactive state unsuitable for actuation of the detonators. In preferred embodiments, the blast number approval component, upon determining that the number of previous blasting events exceeds an approved number of blasting events, consults a blast approval component for authorization for the blasting event.

The blasting apparatuses and methods of the invention that involve a blast number assessment component and a blast number approval component may include any form of cross communication between the blast number assessment component, the blast number approval component and any other components of the blasting apparatus, other devices, and/or associated detonators. For example, such communication may involve wired communication, or wireless communication involving for example cell phone networks or satellite communication as previously described with reference to FIGS. 1 to 9 and other embodiments of the invention. These embodiments may further, as required, involve the use of a cell phone or a computer as at least part of a blast number approval component, which may optionally include communication or data analysis or retrieval via the internet.

The blasting apparatuses and methods of the invention that involve a location assessment component and a location approval component often, but not necessarily, require that the location assessment component be located at or near the blast site so that the geographical location of the blast site can be determined. The positioning of the location approval component, on the other hand, is more flexible, and this component may be located at or near the blast site, or remote from the blast site. In contrast, a blast number assessment component and a blast number approval component may both be located at any position providing that communication is generally maintained with one or more components of the blasting apparatus at the blast site, and/or the detonators at the blast site. For example, the blast number assessment component and the blast number approval component may be incorporated into a single device or "box" located at or near the blast site. Alternatively, blast number assessment component and the blast number approval component may be located far from the blast site, such as for example in a different country, such that communication with the blast site is for example maintained at least in part via a radio link, cell phone communication, satellite communication or the internet.

Any of the embodiments of the invention that involve a blast number assessment component and a blast number approval component may further include, at least in preferred embodiments, a location assessment component and a location approval component for determining whether a location of the blast site is an approved location for blasting and/or a time assessment component and a time approval component for determining whether a time for a blasting event is an authorized time as previously described. In this way, the invention encompasses blasting apparatuses and corresponding methods employing such blasting apparatuses that determine whether a particular blasting event matches an approved location, an approved time, and a blast number for blasting.

Preferably, in accordance with any embodiments of the apparatuses or methods of the invention that include a location approval component, the location approval component (e.g. cell phone, computer etc.) may also have pre-programmed therein one or more approved times for blasting events, preferably corresponding with each of said one or more approved locations. Such pre-programming of approved locations and approved times for blasting events may be carried out by an authorized blast operator. In this way, the location approval component may compare the geographical location of the blasting event, as well as the time of the blasting event, with pre-programmed approved locations and times for blasting events, thereby to determine whether the blasting event is an approved blasting event.

The present invention further encompasses, in any embodiment of the apparatuses and methods disclosed herein, the use of components of the blasting apparatus (such as a location approval component and/or time approval component and/or a blast number approval component) comprising security features such as biometric analysis and/or confirmation means to check the identity of a person attempting to use or pre-program the location approval component for the purposes of setting up or controlling a blasting event. Such biometric analysis may comprise, for example, fingerprint recognition, hand recognition, foot recognition, face recognition, iris recognition, voice recognition, voice command recognition, or any other form of biometric recognition including but not limited to skin spectroscopy analysis or finger vein patterns. A cell phone, computer or any other component of the apparatus may incorporate alternative security features such as alphanumeric, numeric, or voice-implemented password recognition.

For simplicity, the presence of a central command station has not been illustrated in any of the embodiments of the blasting apparatus or methods shown in the Figures of the present application. However, it will be appreciated that any decision signal generated by a location approval component and/or a time approval component and/or a blast number approval component may be received and processed by a central command station, such that the power and/or operation of the central command station is directly influenced by the decision signal. In this way, the maintenance or adoption by the blasting apparatus of an active or inactive state may be controlled at the level of the central command station.

Moreover, any of the embodiments of the apparatuses or methods of the present invention may further include the use of a logger for the logging of authorized detonator usage of detonators each having assigned thereto a unique identification code, as described for example by International patent publication WO00/60305 which is incorporated by reference. In this way, the usage and consumption of detonators may be monitored from a central location, such that detonators can be tracked preferably from their production to their use. It should be noted that such monitoring may be combined with databases in accordance with the present invention for monitoring the geographical location of a blasting event. For example, the present invention encompasses apparatuses and methods involving a single central database located for example on a cell phone or a computer, optionally connected to the internet, for logging detonator usage wherein each detonator comprises a unique identification code. The single database may be located, for example, in the head office of a mining or explosives company. The central database may monitor and record several important pieces of information regarding the use of the detonator, including the place of detonator actuation. Inputting of data into the database may occur after each blasting event has occurred, or may occur "live" such that the database is updated at the same time as (or at least immediately after) each blasting event. Other optional information recorded in the database may include the time of actuation, the person acting as the authorized blast operator for the blast (especially if components of the blast apparatus require biometric analysis for security purposes), the purpose of the blasting event, the prevailing environmental conditions for the blast etc. etc.

The blasting apparatuses and methods of the present invention may further involve the use of means to alert appropriate authorities of any attempt by unauthorized persons to use the blasting apparatus or components thereof, regardless of whether any such attempt is successful or unsuccessful in its illicit aim. For example, if the blasting apparatus comprises a location approval component and/or a time approval component and/or a blast number approval component connected in some way to the internet or a telephone network then the internet or telephone network may send a warning signal to appropriate authorities such as the police. The warning signal may include information regarding the attempted use the blasting apparatus or components thereof selected from one or more of the following: the geographical location of the illicit use, the time of the illicit use, biometric data regarding the person or persons attempting the illicit use, any other information related to the illicit use.

In still further embodiments of the invention, each parameter for assessment and approval may relate to an identification of one or more detonators for a blasting event. Each detonator may be pre-programmed or be able to be programmed with a unique or substantially unique detonator identification code specific for each detonator. In regular operations, such identification codes may be useful, for example, in programming detonators with specific information such as firing codes and delay times. However, such identification codes may be further or alternatively be used in accordance with the invention to designate the use of detonators for one or more specific blasting events. In this way, theft or misuse of detonators for a blasting event other than a designated blasting may result in the detonators being inoperable.

Each blasting apparatus may comprise at least one detonator identification code assessment component for assessing an identification code for each detonator. In a simple form, such an assessment component may comprise a device such as a logger, which programs detonators with identification codes. In other embodiments, the detonators may have already been programmed with detonator identification codes, such that the detonator identification code assessment component obtains detonator identification code information directly from the detonators. In any event, the identity of the detonators may then be passed to a detonator identification code approval component, which compares the identification codes with known identification codes, and if a match is found the blasting apparatus and/or each detonator is caused to maintain or adopt an active state suitable for actuation or control of the detonators.

In preferred embodiments, it will be appreciated that a detonator identification code may be assigned to limit the use of a detonator not only to a specific blasting event, but alternatively to a specific location for a blasting event (e.g. a specific country, site etc.) Under these circumstances, a location assessment component may be present to check that the location matches a designated location. Likewise, a detonator identification code may be assigned to limit the use of a detonator not to a specific blasting event, but alternatively to a specific time or time window for a blasting event. Under these circumstances, a time assessment component may be present to check that the time matches the designated time. Likewise, a detonator identification code may be assigned to limit the use of a detonator not only to a specific blasting event, but alternatively to a specific blast operator for a blasting event. Under these circumstances, a blast operator assessment component may be present to check that the blast operator matches the designated blast operator.

In this way, the use of detonator identification codes may permit detonators to be sold or distributed having pre-programmed identification codes, where the detonators are operable for example only in the hands of a designated customer, and/or at a specific place, and/or at a specific time. Therefore, the supplier of the detonators may retain overall control of the detonators and limit their use in the field, such that theft, inadvertent or illicit use of the detonators may be foiled. In preferred embodiments, the supplier may retain control of the detonators from a central office. For example, the use or attempted use of detonators may be "watched" by a central office having a database of future approval detonator or blast apparatus uses. For each blasting event, a blast apparatus may contact the central office to request permission to proceed with a blasting event on the basis of the detonators identified at the blast site for the event, as well as other parameters for the event such as the location and/or the time and/or the identity of the blast operator. Following approval this information for the blasting event from the central office, the blasting event may proceed, and all information regarding what was fired, where it was fired, when it was fired, and who was responsible for the firing (i.e. what, where, when, who) may be logged in a database, for example at the central office. The central office may be located at the blast site or at a location remote from the blast site, even in a different country.

Whilst the invention has been described with reference to specific embodiments of the blasting apparatuses, and methods of blasting of the present invention, a person of skill in the art would recognize that other blasting apparatuses, and methods of blasting that have not been specifically described would nonetheless lie within the spirit of the invention. It is intended to encompass all such embodiments within the scope of the appended claims.

The invention claimed is:

1. An apparatus for controlling actuation of at least one detonator for a blasting event at a blast site, said apparatus comprising:

at least one blasting machine for transmitting command signals to said at least one detonator via direct electrical connection or wireless communication;

for each of said at least one detonator, a substantially unique detonator identification code assigned to said detonator, at least one assessment component that assesses the at least one detonator identification code of said at least one detonator, and thereby, at least one of the parameters of the at least one detonator's use at a specific location, at a specific time or within a specific time window, or by a specific blast operator;

at least one approval component that approves the detonator identification code of said at least one detonator by comparing said at least one detonator identification code of said at least one detonator with at least one approved detonator identification code;

each of said at least one detonator being actuatable upon receipt from said at least one blasting machine of at least one command signal to FIRE, and/or said blasting machine being able to transmit a command signal to FIRE to each detonator, only if a detonator identification code for the detonator and any of said at least one approved detonator identification codes correspond, and thereby said at least one parameter is determined by said at least one approval component to correspond to at least one of said designated location, designated time or time window and designated blast operator.

2. The apparatus of claim 1 further comprising a location assessment component, each detonator identification code being assigned its designated specific location, said blasting apparatus being unable to cause detonator actuation and/or each detonator being unresponsive to said blasting machine if said blasting apparatus or at least one component thereof, or said at least one detonator, is determined by said location assessment component to be in a location other than said designated location.

3. The apparatus of claim 1 further comprising a time assessment component, each detonator identification code being assigned its designated specific time or time window, said blasting apparatus being unable to cause detonator actuation and/or each detonator being unresponsive to an associated blasting machine if said time or time window is determined by said time assessment component to include a time other than said designated time or time window.

4. The apparatus of claim 1 further comprising a blast operator assessment component, each detonator identification code being assigned its designated specific blast operator, said blasting apparatus being unable to cause detonator actuation and/or each detonator being unresponsive to an associated blasting machine if a blast operator is determined by said blast operator assessment component to be a blast operator other than said designated blast operator.

5. A method of controlling a blasting event at a blast site with a blasting apparatus according to claim 1, the blast site having positioned therein at least one detonator and associated explosive charges, each detonator being adapted to receive via direct electrical connection or wireless communication command signals transmitted or relayed by at least one associated blasting machine, the method comprising:

providing for each of the at least one detonator a substantially unique detonator identification code assigned to said detonator, determining via the at least one detonator identification code assessment component an identification code for each detonator, and thereby, at least one of the parameters of the at least one detonator's use at a specific location, at a specific time or within a specific time window, or by a specific blast operator; and determining via the at least one detonator identification code approval component whether the identification code for each detonator matches any of said at least one approved detonator identification codes;

each of said at least one detonator being actuatable upon receipt from said at least one blasting machine of at least one command signal to FIRE, and/or said blasting machine being able to transmit a command signal to FIRE to each detonator, only if a detonator identification code for the detonator and any of said at least one approved detonator identification codes correspond, and thereby said at least one parameter is determined by said at least one approval component to correspond to at least one of said designated location, designated time or time window and designated blast operator.

6. The method of claim 5, the apparatus further comprising a location assessment component, the method comprising the step of: determining via said location assessment component a location of said apparatus, a component thereof, or said at least one detonator;

each detonator identification code being assigned its designated specific location, said blasting apparatus being unable to cause detonator actuation and/or each detonator being unresponsive to said blasting machine if said blasting apparatus or at least one component thereof, or said at least one detonator, is determined by said location assessment component to be in a location other than a designated location.

7. The method of claim 5, the apparatus further comprising a time assessment component, the method further comprising the step of: determining via said time assessment component a time or time window for said blasting event;

each detonator identification code being assigned its designated specific time or time window, said blasting apparatus being unable to cause detonator actuation and/or each detonator being unresponsive to an associated blasting machine if said time or time window is determined by said time assessment component to include a time other than a designated time or time window.

8. The method of claim 5, the apparatus further comprising a blast operator assessment component, the method further comprising the step of: determining via said blast operator assessment component an identification of a blast operator;

each detonator identification code being assigned its designated specific blast operator, said blasting apparatus being unable to cause detonator actuation and/or each detonator being unresponsive to an associated blasting machine if a blast operator is determined by said blast operator assessment component to be a blast operator other than a designated blast operator.

* * * * *